US006609292B2

(12) United States Patent
Kurita

(10) Patent No.: US 6,609,292 B2
(45) Date of Patent: Aug. 26, 2003

(54) METHOD OF MAKING CHIP RESISTOR

(75) Inventor: Yoshio Kurita, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/924,541

(22) Filed: Aug. 9, 2001

(65) Prior Publication Data

US 2002/0026706 A1 Mar. 7, 2002

(30) Foreign Application Priority Data

Aug. 10, 2000 (JP) ..... 2000-242485
Aug. 10, 2000 (JP) ..... 2000-242486
Aug. 10, 2000 (JP) ..... 2000-242487

(51) Int. Cl.[7] ..... H01C 17/00

(52) U.S. Cl. ..... 29/610.1; 29/619; 29/620; 29/25.42; 338/307

(58) Field of Search ..... 29/610.1, 412, 29/417, 619, 620, 621, 25.41, 25.42; 338/307, 308

(56) References Cited

U.S. PATENT DOCUMENTS 4,264,888 A * 4/1981 Berg ..... 219/505
4,792,781 A * 12/1988 Takahashi et al. ..... 29/610.1
6,151,771 A * 11/2000 Tzeng et al. ..... 29/610.1
6,314,637 B1 * 11/2001 Kimura et al. ..... 29/610.1

FOREIGN PATENT DOCUMENTS

JP 60-49609 3/1985 ..... H01C/17/00
JP 6-46602 6/1994 ..... H01C/17/06
JP 6-73324 9/1994 ..... H01C/17/06

* cited by examiner

*Primary Examiner*—Gregory Vidovich
*Assistant Examiner*—Stephen Kenny
(74) *Attorney, Agent, or Firm*—Michael D. Bednarek; Shaw Pittman LLP

(57) ABSTRACT

A method of making a small chip resistor properly and efficiently is provided. This method makes chip resistors each of which comprises a unit substrate which is rectangular as viewed in plan and has a predetermined thickness, a resistor element provided on an upper surface of the substrate, and electrodes provided at opposite ends of the unit substrate. The method includes the steps of continuously forming a green sheet, obtaining from the green sheet an intermediate product in the form of a narrow strip on which electrodes and resistor elements are printed, at least the resistor elements being printed at a pitch corresponding to the unit substrates, forming slits on the intermediate product for dividing the intermediate product into the unit substrates, each of the slits extending perpendicularly to the longitudinal direction of the intermediate product, simultaneously baking the intermediate product together with the printed electrodes and the printed resistor elements, and dividing the baked intermediate product along the slits into the unit substrates.

13 Claims, 18 Drawing Sheets

METHOD OF MAKING CHIP RESISTOR

BACKGROUND OF THE INVENTION

1. Field of the Invention

The present invention relates to a method of making a chip resistor for surface mounting on a printed circuit board for example.

2. Description of the Related Art

Recently, for enhancing a mounting density on a circuit board, various electronic components are being replaced with chip-type components which can be surface-mounted. As a typical example of chip-type electronic component, there exists a chip resistor of the type as shown in FIG. 26. Specifically, the chip resistor includes a substrate 70 made of a ceramic material for example, film electrodes 71 formed to cover the opposite side surfaces and some parts of the upper and the lower surfaces of the substrate 70, a film resistor 72 bridging the film electrodes 71 on the upper surface of the substrate 70, and a protective coating 73 for protecting the film resistor 72.

The chip resistor is made generally in the following manner. Specifically, as shown in FIG. 27, use is made of a mother substrate 74 which is substantially flat and prepared by baking a ceramic material. The mother substrate 74 is formed with a plurality of longitudinally-dividing grooves 75 (hereinafter referred to as BB slit which is an abbreviation of bar break slit) arranged at a regular pitch, and a plurality of transversely-dividing grooves 76 (hereinafter referred to as CB slit which is an abbreviation of chip break slit) arranged at a regular pitch. The respective slits 75, 76 define generally rectangular unit substrates 77 which are finally formed into chip resistors.

Subsequently, as shown in FIG. 28, film electrodes 71 as electrode terminals are collectively formed on the upper surface of the mother substrate 74. Specifically, the film electrodes are formed at opposite ends of each of the unit substrates 77 by printing and baking. Thereafter, film resistors 72 are collectively formed on the unit substrates 77 by printing and baking.

The mother substrate 74 is then divided widthwise along the BB slits 75 to provide intermediate products each in the form of a narrow strip. Subsequently, after predetermined electrode material is printed and baked on the side and the lower surfaces of each of the intermediate products, the intermediate product is divided along the CB slits 76.

The resistance of each of the film resistors 72 is adjusted by so-called laser trimming in the state of the mother substrate 74. Specifically, a trimming groove is formed on each film resistor 72 by laser application for providing a predetermined resistance while measuring the resistance with a measurement probe brought into contact with film electrodes 71 provided at opposite ends of the film resistor 72.

In forming the film electrodes 71 and the film resistors 72 by the above-described chip resistor making, a print mask 79 as shown in FIG. 29, which includes openings 78 formed in accordance with the printing pattern of the film electrodes 71 or the like, is disposed on the mother substrate 74. In this state, by moving a squeegee on the print mask 79 for example, printing paste is applied and printed on the mother substrate 74 through the openings 78 of the print mask 79.

However, when the mother substrate 74 made of ceramic material is baked, the mother substrate 74 may shrink widthwise or longitudinally to some extent. Therefore, when the above-described print mask 79 is disposed on the mother substrate 74, the pitch of the openings 78 of the print mask 79 does not coincide with the pitch of the BB slits 75 and CB slits 76, thereby causing print deviation.

Hitherto, therefore, a plurality of (practically no less than 100 kinds of) print masks 79 are prepared which are identical in printing pattern but slightly different in position of openings 78. Thus, for applying printing paste on the mother substrate 74 to form film electrodes 71 or the like, a print mask 79 having openings 78 which correspond to the slits 75, 76 of the shrunk mother substrate 74 is selected and disposed on the mother substrate 74. However, preparation of a multiplicity of print masks 79 in accordance with shrinkage of the mother substrate 74 is uneconomical.

Further, in recent years, size-reduction of a chip resistor is increasingly demanded. However, there is a limitation on and a difficulty in reducing the size of a chip resistor by the above-described method which utilizes the print mask 79 for forming the film electrodes 71 and the film resistors 72.

On the other hand, JP-A-63-224305 discloses another method of making a chip resistor. This method comprises the steps of extruding a substrate material into a non-baked green substrate bar, printing electrodes and resistors on the green substrate bar, simultaneously baking the substrate bar together with the electrodes and the resistors, and finally dividing the substrate bar into unit substrates.

With this method, since the substrate bar together with the electrodes and the resistors are simultaneously baked, it is possible to alleviate the printing deviation of the electrodes and the resistors relative to the substrate bar, or the printing deviation of the resistors relative to the electrodes.

However, the above-described method includes the step of forming, by extrusion, a non-baked green substrate having a cross section which corresponds to the cross section of an aimed chip resistor. With this method, however, it is very difficult to form extremely small chip resistors of a dimension of, for example, no more than 1 mm so as to have uniform cross sections. This is partially because it is very difficult to adjust a substrate material, which is a suspension of ceramic particles and a solvent so as to have viscosity suitable for extrusion. Further, it is not practical to form a green substrate bar of a uniform cross section by continuously extruding the substrate material through a very small nozzle hole.

SUMMARY OF THE INVENTION

It is therefore an object of the present invention to provide a method of making a chip resistor which is capable of realizing size reduction of a chip resistor and enhancing production efficiency.

In accordance with the present invention, there is provided a method of making chip resistors each of which comprises a unit substrate which is rectangular as viewed in plan and has a predetermined thickness, a resistor element provided on an upper surface of the substrate, and electrodes provided at opposite ends of the unit substrate, the method comprising the steps of:

continuously forming a green sheet;

obtaining from the green sheet an intermediate product in the form of a narrow strip on which electrodes and resistor elements are printed, at least the resistor elements being printed at a pitch corresponding to the unit substrates;

forming slits on the intermediate product for dividing the intermediate product into the unit substrates, each of the slits extending perpendicularly to the longitudinal direction of the intermediate product;

simultaneously baking the intermediate product together with the printed electrodes and the printed resistor elements; and dividing the baked intermediate product along the slits into the unit substrates.

In a preferred embodiment, the step of obtaining the intermediate product is performed by cutting the green sheet into a narrow substrate strip of a predetermined width extending longitudinally of the green sheet followed by printing thereon the electrodes and the resistor elements.

In a preferred embodiment, corners of the substrate strip are rounded in cutting the green sheet into the narrow substrate strip of the predetermined width.

In a preferred embodiment, an upper surface of the narrow substrate strip is formed, at widthwise opposite edges thereof, with longitudinally extending stepped portions of a predetermined width.

In a preferred embodiment, an upper surface of the narrow substrate strip is formed, at a widthwise central portion thereof, with a longitudinally extending recess having a predetermined width.

In a preferred embodiment, in the step of obtaining the intermediate product, the electrodes and the resistor elements are printed by longitudinally transferring the narrow substrate strip and rotating printing rollers in contact with an upper surface, side surfaces and lower surface of the narrow substrate strip.

In a preferred embodiment, in the step of obtaining the intermediate product, the narrow substrate strip is longitudinally transferred while the electrodes and the resistor elements are printed by performing inkjet printing with respect to an upper surface, side surfaces and lower surface of the narrow substrate strip.

In a preferred embodiment, in the step of forming the slits on the intermediate product, each of the slits is formed to have a depth which is about one half of a thickness of the intermediate product.

In a preferred embodiment, the step of dividing the baked intermediate product along the slits into the unit substrates is performed by attaching the baked intermediate product onto a stretchable tape for transferring while tightly sandwiching the same between dividing rollers provided above and below.

Preferably, in this case, the method further includes the step of performing resistance adjustment after the division into the unit substrates, and the resistance adjustment is performed while conducting resistance measurement for each of the resistor elements by bringing electrode rollers into contact with corresponding electrodes of each unit substrate with the stretchable tape stretched.

In a preferred embodiment, each of the resistor elements is subjected to resistance adjustment with respect to the intermediate product after the baking and before the division into unit substrates.

Preferably, in this case, the resistance adjustment for each of the resistor elements is performed while performing resistance measurement for the resistor element by bringing electrode rollers into contact with corresponding electrodes on the intermediate product.

In a preferred embodiment, the step of obtaining the intermediate product is performed by cutting the green sheet into the substrate strip of a predetermined width after printing a plurality of electrodes and resistor elements on an upper surface of the green sheet in a matrix arrangement.

Preferably, in this case, the printing is performed using a print mask which includes openings corresponding to an electrode pattern or a resistor element pattern.

Other features and advantages of the present invention will become clearer from the detailed description given below with reference to the accompanying drawings.

DETAILED DESCRIPTION OF THE PREFERRED EMBODIMENTS

A chip resistor made by the method of the present invention comprises a rectangular unit substrate of a predetermined thickness, electrodes formed at longitudinal edges of the substrate so as to extend over the upper surface, the side surfaces and the lower surface thereof, and a resistor element formed on the upper surface of the unit substrate so as to bridge the opposite electrodes. The chip resistor has a configuration suitable for surface mounting on a mount object such as a printed circuit board for example. In particular, the present invention is suitable for properly and efficiently making a chip resistor of a smaller size.

A method of making a chip resistor according to the present invention basically includes ① a step of continuously forming a green sheet, ② a step of obtaining from the green sheet an intermediate product in the form of a narrow strip on which electrodes and resistor elements are printed, at least the resistor elements being printed at a pitch corresponding to unit substrates; ③ a step of forming slits on the intermediate product for dividing the intermediate product into the unit substrates, each of the slits extending perpendicularly to the longitudinal direction of the intermediate product; ④ simultaneously baking the intermediate product together with the printed electrodes and the printed resistor elements; and ⑤ dividing the baked intermediate product along the slits into the unit substrates.

A first embodiment of the method according to the present invention will be described below with reference to FIGS. 1 through 16.

Figure 1:
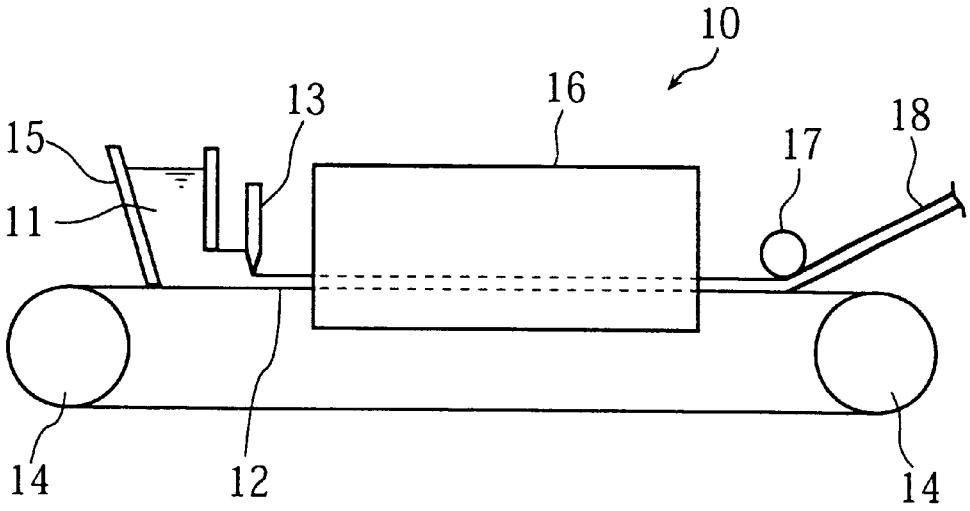
FIG. 1 illustrates a step of forming a green sheet.

In the step of continuously forming a green sheet, a green sheet forming apparatus 10 as shown in FIG. 1 is used. Specifically, in the green sheet forming apparatus 10, a viscous suspension 11 (also called slip) containing, for example, alumina powder and glass powder is continuously guided out, as carried by a transfer belt 12 moving at a constant speed, through a space between the transfer belt 12 and a doctor blade 13 arranged in facing relation to the transfer belt 12 with a predetermined spacing. The transfer belt 12 is wound around a pair of rollers 14 which are rotatably arranged.

A liquid reservoir 15 for storing the suspension 11 is provided upstream from the doctor blade 13, whereas a drying furnace 16 for drying the suspension 11 at a predetermined temperature is provided downstream from the doctor blade 13. The suspension 11 is formed, by the transfer belt 12 and the doctor blade 13, into a strip having a predetermined thickness and width and dried in the drying furnace 16 to provide a solid strip. The solid strip is peeled off the transfer belt 12 by a peeling roller 17. Thus, a green sheet 18 in the form of a strip is provided. It is to be noted that the thickness of the green sheet 18 can be varied by changing the distance between the transfer belt 12 and the doctor blade 13.

Figure 2:
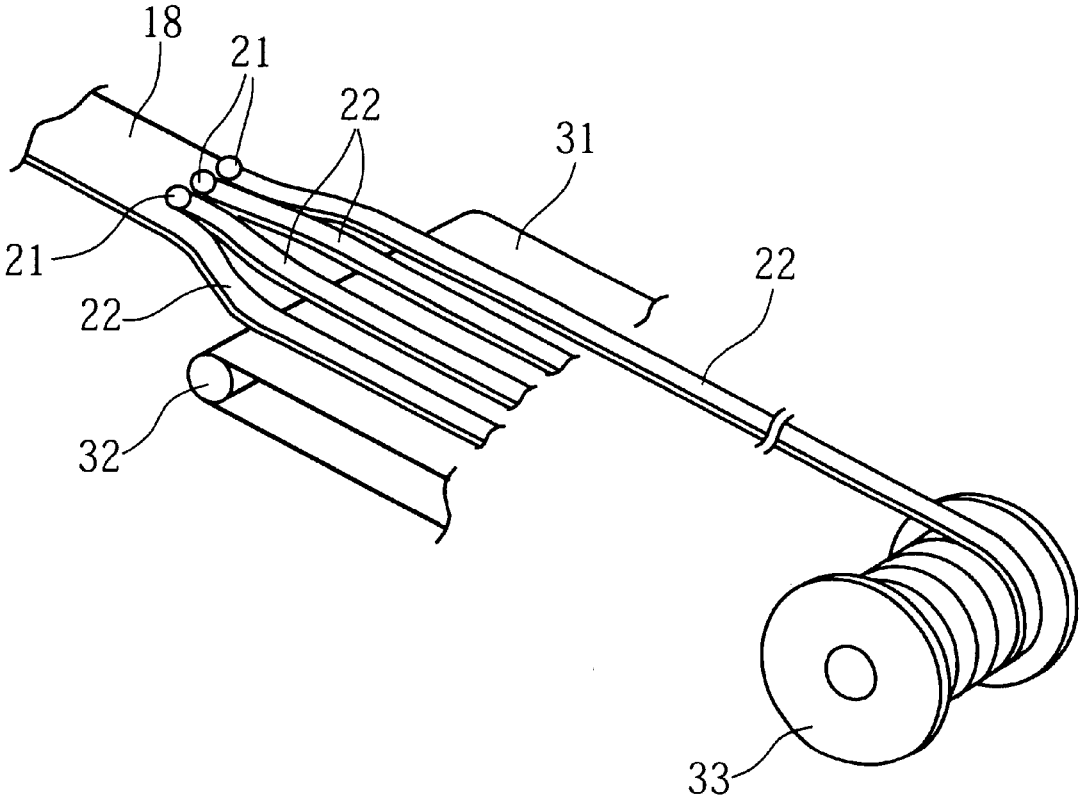
FIG. 2 illustrates a step of dividing the green sheet into narrow substrate strips.
Figure 3A:
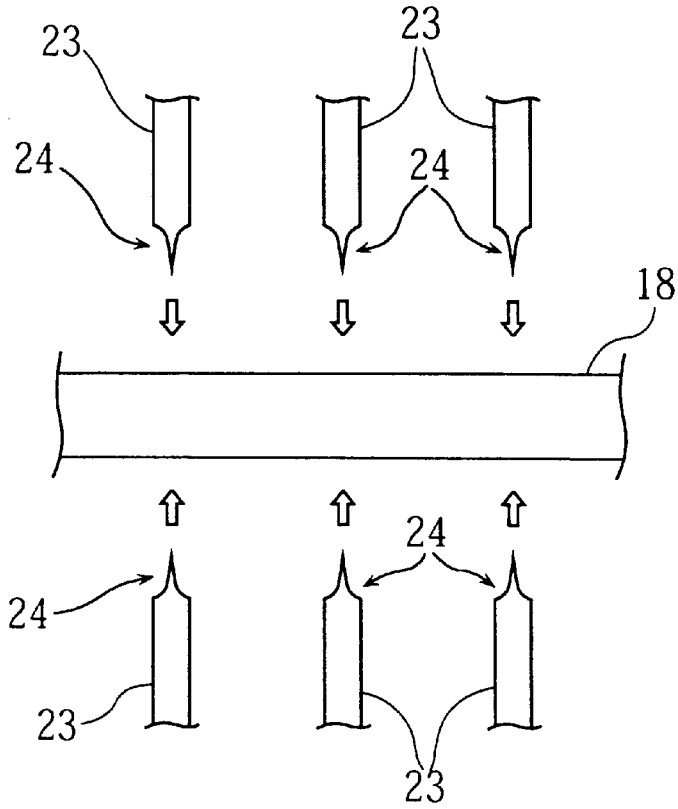
FIGS. 3A and 3B illustrate the manner of dividing a green sheet into narrow substrate strips by rotating slitters.
Figure 3B:
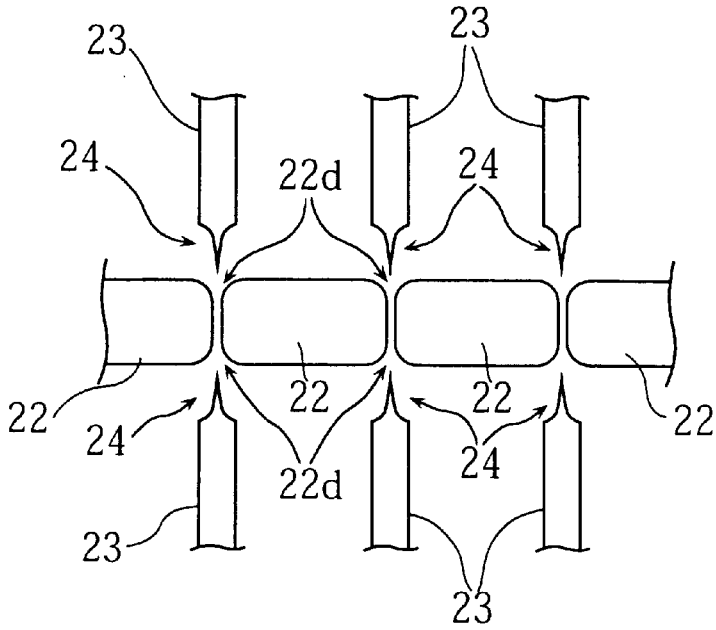
Figure 4:
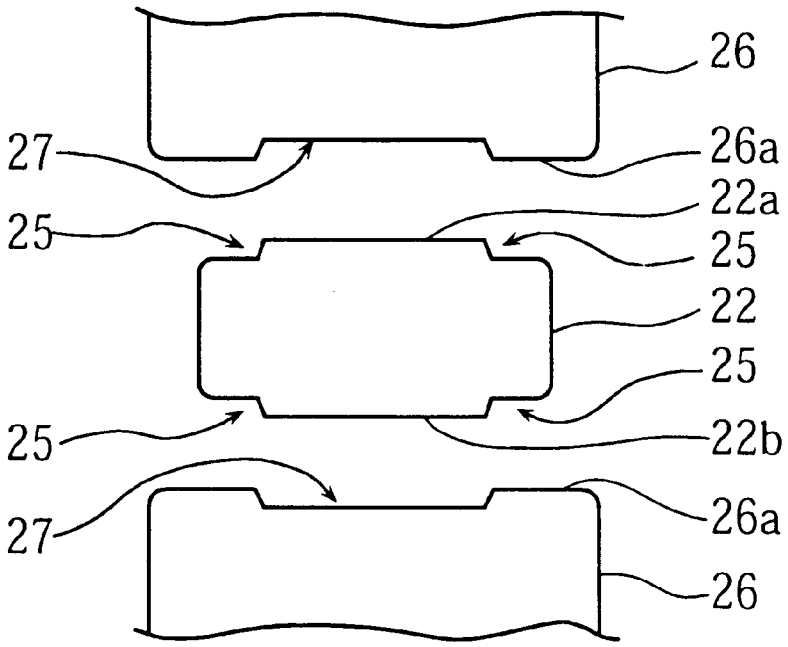
FIG. 4 illustrates an example of working for a narrow substrate strip.

To be described next is the step of obtaining an intermediate product 22A in the form of a narrow strip on which electrodes and resistor elements are printed, at least the resistor elements being printed at a pitch corresponding to unit substrates. In this embodiment, the above-described green sheet is divided into a plurality of narrow substrate strips 22 each having a predetermined width and extending longitudinally of the green sheet. Specifically, the green sheet 18 is cut by a plurality of rotating slitters 21 into the narrow substrate strips 22, as shown in FIG. 2, In dividing the green sheet 18 into the narrow substrate strips 22 with the rotating slitters 21, it is preferable to use rotating slitters 23 of the type shown in FIGS. 3A and 3B, each of which has a sharp circumferential edge flanked by a pair of cross-sectionally concave surfaces. The green sheet 18 is cut by sandwiching the green sheet 18 from above and below by the rotating slitters 23.

By conducting the cutting in this way, the green sheet 18 is worked in accordance with the configuration of the rotating slitters 23. Thus, each of the narrow substrate strips 22 is rounded in cross section at the four corners 22*d*. Therefore, with a method which will be described later, it is possible to print electrodes on the upper surface, the side surfaces, and part of the lower surface of the narrow substrate strip 22 without breaking the electrodes at the corners 22*d*.

It is to be noted that the narrow substrate strip 22 may be formed with stepped portions 25 extending along the longitudinal edges of the upper and the lower surfaces 22*a*, 22*b* of the narrow substrate strip 22. The stepped portions 25 may be formed by pressing predetermined portions of the upper and the lower surface 22*a*, 22*b* of the narrow substrate strip 22 by rotating rollers 26. Each of the rollers 26 is provided with a recess 27 formed centrally of the circumferential surface 26*a* for facing the upper or the lower surface 22*a*, 22*b* of the narrow substrate strip 22.

Figure 5:
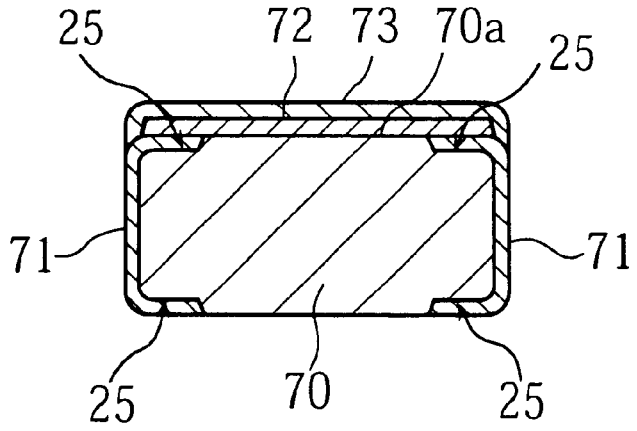
FIG. 5 is a sectional view showing a chip resistor made from a narrow substrate strip which has undergone dividing and working as shown in FIGS. 3A and 3B.

As shown in FIG. 5, in the case where the stepped portions 25 are formed in this way, electrode paste for forming film electrodes 71 can be received in the stepped portions 25, so that the upper surfaces of the film electrodes 71 after the printing become flush with the upper surface 70*a* of the substrate 70. As a result, it is possible to uniformly print the film resistor 72 and a protective coating 73 on the upper surface 70*a* of the substrate 70 so as not to include irregularities.

Figure 6:
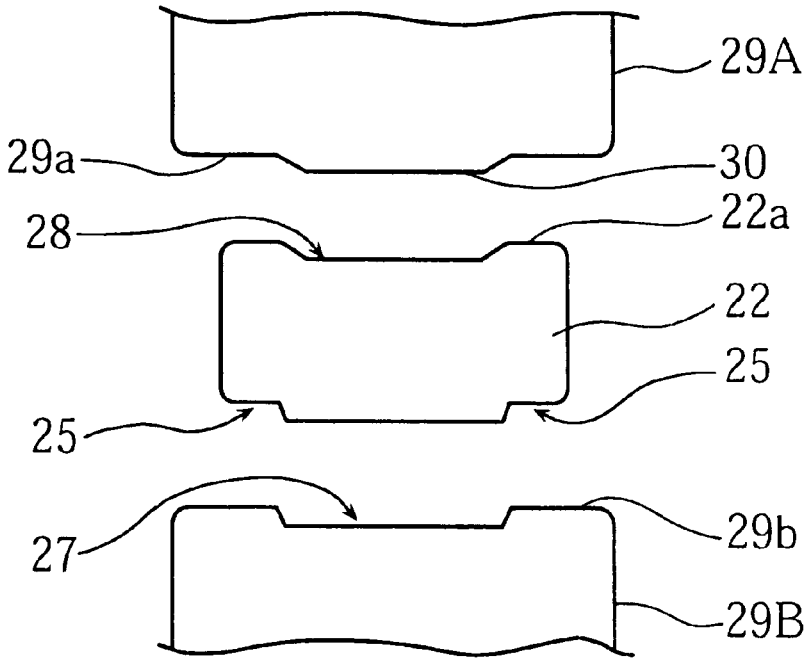
FIG. 6 illustrates another example of working for a narrow substrate strip.

Alternatively, as shown in FIG. 6, the upper surface 22*a* of the narrow substrate strip 22 may be centrally formed with a longitudinally extending recess 28 of a predetermined width. The recess 28 may be formed by pressing the upper and the lower surfaces 22*a*, 22*b* of the narrow substrate strip 22 by rotating rollers 29A, 29B, respectively. One roller 29A has a surface 29*a* including a central bulging portion 30 for facing the upper surface of the intermediate product 22. The other roller 29B is formed with a recess 27 at the widthwise central portion thereof, similarly to the rollers 26 shown in FIG. 4.

Figure 7:
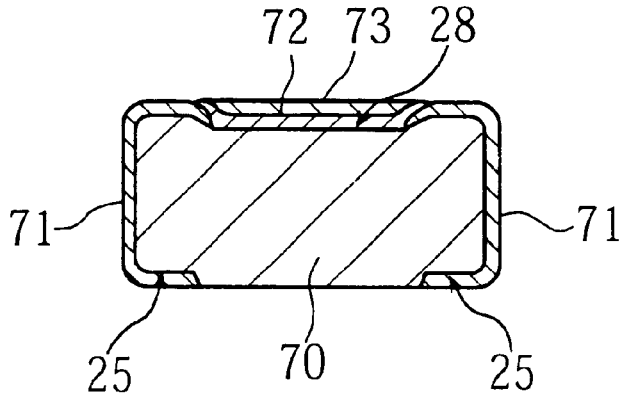
FIG. 7 is a sectional view showing a chip resistor made from a narrow substrate strip which has undergone working as shown in FIG. 6.

As shown in FIG. 7, in the case where the recess 28 is formed on the upper surface 22*a* of the narrow substrate strip 22 as described above, it is possible to receive the film resistor 72 and the protective coating 73 in the groove. This makes it possible to eventually obtaining unit substrates which are generally in the form of a rectangular parallelepiped and are convenient in handling.

Returning to FIG. 2, the narrow substrate strip 22 is longitudinally transferred downstream by a transfer belt 31 and then wound around a drum 33. The transfer belt 31 is wound around a pair of rotatably supported rollers 32 (one of which is not shown). It is to be noted that the width of the narrow substrate strip 22 may be changed by appropriately changing the distance between the plurality of slitters 21. Although a single drum 33 is illustrated in FIG. 2, there are also provided other drums for winding the narrow substrate strips 22, respectively.

Figure 8:
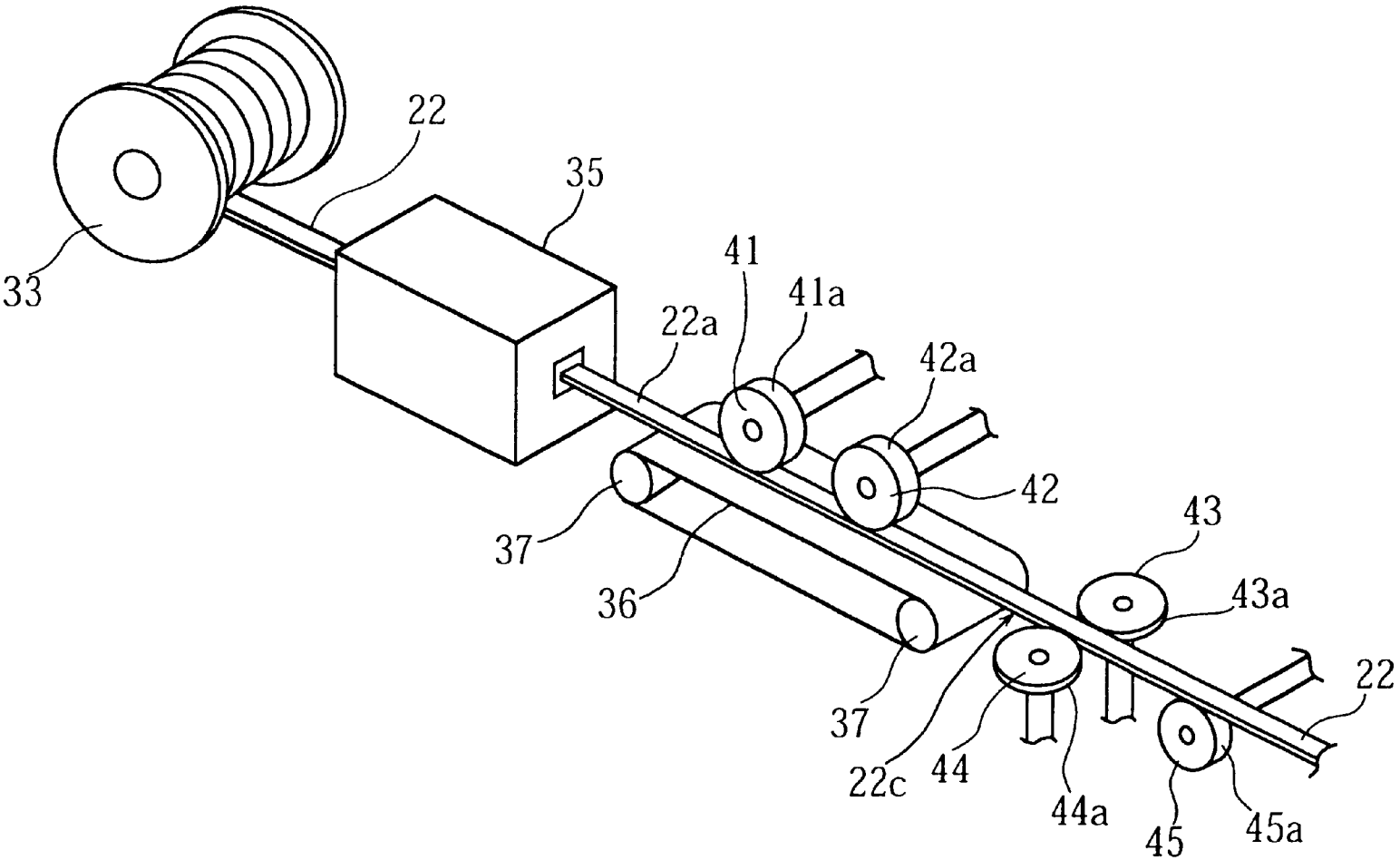
FIG. 8 is a schematic perspective view showing an example of printing apparatus for printing electrodes and resistor elements on a narrow substrate strip.

Subsequently, each of the narrow substrate strips 22 is transported as wound around the drum 33 for undergoing aging. Specifically, as shown in FIG. 8, the narrow substrate strip 22 is paid out from the drum 33 and guided into an aging furnace 35 by a non-illustrated guiding apparatus. In the aging furnace 35, the narrow substrate strip 22 is heated for a predetermined period of time for accelerating drying so that the narrow substrate strip 22 becomes a stable state which allows easy working. This aging step provides the narrow substrate strip 22 with hardness which is suitable for performing a printing step and a CB slit forming step which will be described later. Instead of using the aging furnace 35, aging may be performed just by leaving the narrow substrate strip 22 wound around the drum 33 for a predetermined period.

Subsequently, the method proceeds to a step of printing electrode paste and resistor paste for forming electrodes and resistor elements to provide an intermediate product 22A. Specifically, the narrow substrate strip 22 exiting the aging furnace 35 is longitudinally transferred downstream by a transfer belt 36, while performing printing of print paste on the narrow substrate strip. The transfer belt 36 is wound around a pair of rotatably supported rollers 37.

For performing the printing, the transfer belt 36 is upwardly provided with a first printing roller 41 and a second printing roller 42 for printing electrodes and resistor elements on the upper surface 22*a* of the narrow substrate strip 22. The first printing roller 41 is arranged upstream from the second printing roller 42. The first and the second rollers 41, 42 have respective rotation shafts extending transversely of the transfer belt 36 and respective circumferential surfaces 41*a*, 42*a* for rotating in a vertical plane while facing the upper surface 22*a* of the narrow substrate strip 22.

The electrode paste may contain a conductive material such as silver as a main component. The resistor paste may contain a metal or a metal oxide having predetermined electrical resistance properties.

Further, a third printing roller 43 and a fourth printing roller 44 for printing electrode paste on the side surfaces 22*c* of the narrow substrate strip 22 are provided downstream from the transfer belt 36. The printing rollers 43, 44 have respective rotation shafts extending downward relative to the narrow substrate strip 22 and respective circumferential surface 43*a*, 44*a* which rotate in a horizontal plane while sandwiching the opposite side surfaces 22*c* of the narrow substrate strip 22.

Moreover, a fifth printing roller 45 for printing electrode paste on the lower surface 22*b* of the narrow substrate strip 22 is provided downstream from the third and the fourth printing roller 43, 44. The fifth printing roller 45 has a rotation shaft extending transversely of the narrow substrate strip 22, and a circumferential surface 45*a* for rotating in a vertical plane while facing the lower surface 22*b* of the narrow substrate strip 22.

Figure 9:
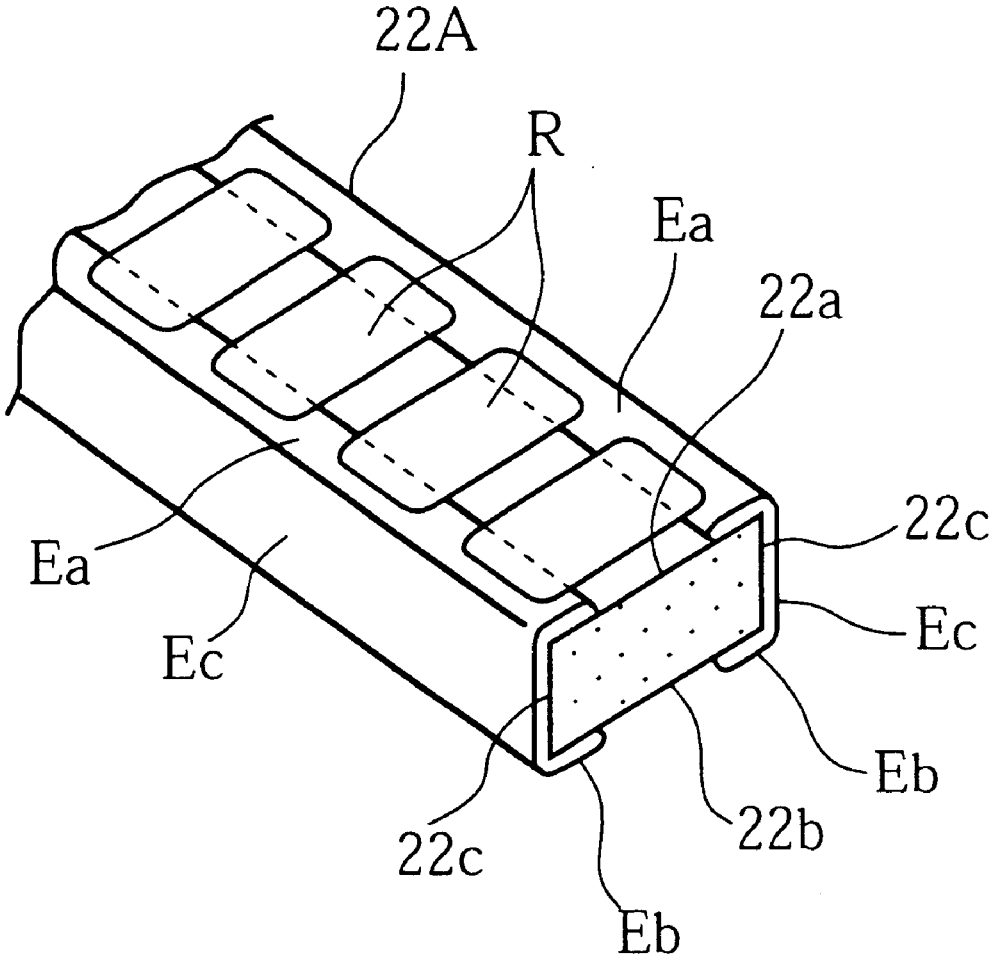
FIG. 9 is a perspective view showing a narrow substrate strip after electrodes and resistor elements are printed thereon by the printing apparatus shown in FIG. 8.

With the above-described structure, as the narrow substrate strip 22 exiting the aging furnace 35 is transferred as carried by the transfer belt 36, the upper surface 22*a* of the narrow substrate strip is brought into contact with the circumferential surfaces 41*a*, 42*a* of the first and the second printing rollers 41, 42. Thus, as shown in FIG. 9, the first printing roller 41 prints electrode paste Ea at opposite edges on the upper surface 22 of the narrow substrate strip 22. Thereafter, the second printing roller 42 prints resistor paste R at predetermined portions of the upper surface 22*a* of the narrow substrate strip 22 at a predetermined pitch longitudinally of the substrate. In this case, the resistor paste R is so formed as to partially overlap the electrode paste Ea at opposite edges on the upper surface 22*a* of the narrow substrate strip 22.

Preferably, non-illustrated blowers are provided between the first printing roller 41 and the second printing roller 42 as well as downstream from the second printing roller 42 for drying, with air, the narrow substrate strip 22 on which each kind of print paste is printed by the printing rollers 41, 42.

Subsequently, the narrow substrate strip 22 on the upper surface 22*a* of which each kind of the print paste is printed is further transferred by the transfer belt 36 so that the side surfaces 22*c* come into contact with the circumferential surfaces 43*a*, 44*a* of the third and the fourth printing rollers 43, 44. Thus, as shown in FIG. 9, electrode paste Ec is printed on the opposite side surfaces 22*c* of the narrow substrate strip 22. In this case, the electrode paste Ec is so printed as to be electrically connected to the electrode paste Ea printed on the upper surface 22*c* of the narrow substrate strip 22.

Preferably, a non-illustrated blower is provided downstream from the third and the fourth printing rollers 43, 44 for drying, with air, the narrow substrate strip 22 on which the paste is printed by the printing rollers 43, 44.

After the electrode paste Ec is printed on the side surfaces 22*c*, the narrow substrate strip 22 is further transferred by the transfer belt 36 so that the lower surface 22*b* comes into contact with the circumferential surface 45*a* of the fifth printing roller 45. Thus, electrode paste Eb is printed at opposite edges on the lower surface 22*b* of the narrow substrate strip 22. In this case, the electrode paste Eb is so printed as to be electrically connected to the electrode paste Ec on the side surfaces 22*c* of the narrow substrate strip 22 printed by the third and fourth printing rollers 43, 44.

Preferably, a non-illustrated blower is provided downstream from the fifth printing rollers 45 for drying, with air, the narrow substrate strip 22 on which the electrode paste Eb is printed by the fifth printing roller 45.

In this way, from the green sheet, an intermediate product 22A is obtained, which is in the form of a narrow strip and formed with electrodes and resistor elements. At least the resistor elements are printed in a pitch corresponding to unit substrates.

In the above-described making method which is utterly different from the prior art method, a narrow substrate strip 22 is first formed. Then, with respect to the upper, the lower, and the side surfaces 22*a*, 22*b*, 22*c* of the narrow substrate strip 22, electrodes and resistor elements are formed by printing paste by the printing rollers 41–45, while transferring the substrate by the transfer belt 36.

In the prior art making method, a print mask is used in printing paste on a mother substrate. However, positional deviation of the print paste may often occur due to shrinkage of the mother substrate in baking, so that plural kinds of print masks need be uneconomically prepared for printing the paste. With the above-described method, however, printing is performed with respect to the narrow substrate strip 22 which differs in configuration from the mother substrate. Therefore, a print mask is not necessary so that positional deviation of the print paste does not occur. As a result, it is possible to reduce defective products as well as the manufacturing cost and to enhance the production efficiency.

In particular, since the first and the second printing rollers 41, 42 rotate in a vertical plane, it is possible to print the paste uniformly on the upper surface 22*a* of the narrow strip layer 22.

Moreover, according to this embodiment in which the print paste is printed directly on the narrow substrate strip 22 by respective printing rollers 41–45 without using a print mask, it is possible to print the paste even on a narrow substrate strip 22 of a smaller size without causing deviation of the print paste. Therefore, it is possible to realize the size reduction of a chip resistor.

The arrangement of the printing rollers 41–45 is not limited to that shown in FIG. 8. For example, the fifth printing roller 45 may be arranged closest to the aging furnace 35. Further, a protective coating may be further formed on the resistor paste on the narrow substrate strip 22.

Figure 10:
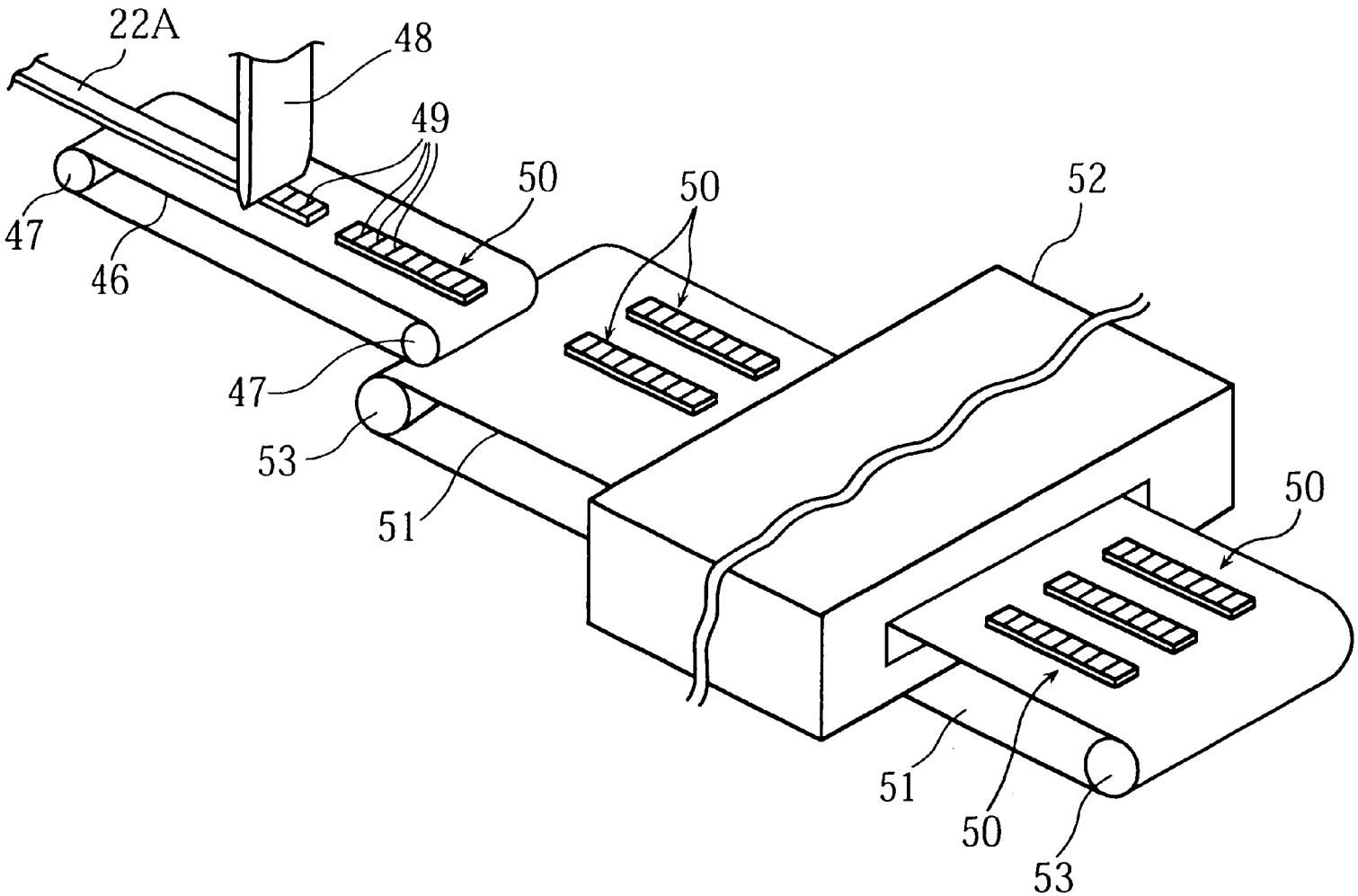
FIG. 10 is a schematic perspective view showing the manner of dividing a narrow substrate strip after printing into substrate sub-strips each having a predetermined length and baking the same.

The intermediate product 22A obtained by printing predetermined electrode paste and resistor paste on the narrow substrate strip 22 in the above-described manner is then transferred as carried by a transfer belt 46, as shown in FIG. 10. The transfer belt 46 is wound around a pair of rollers which are rotatably arranged.

A cutter 48 which is movable upward and downward is provided above the transfer belt 46. The cutter 48 is used for forming CB slits on the upper surface 22*a* of the intermediate product 22A and for dividing the intermediate product 22A into substrate sub-strips 50 each of which is a series of unit substrates. The cutter 48 may be provided with a plurality of blades for simultaneously forming a plurality of CB slits 49.

Thus, the intermediate product 22A transferred by the transfer belt 46 is formed, on the obverse surface thereof, with the CB slits 49. Each of the CB slits 49 is V-shaped and serves as a mark for division into unit substrates. The CB slit is formed at a predetermined position between respective adjacent deposits of resistor paste arranged at a predetermined pitch on the upper surface of the intermediate product 22A.

After an appropriate number of (ten for example) CB slits 49 are formed in succession, the intermediate product 22A are cut widthwise. That is, the intermediate product is divided into substrate sub-strips 50 each comprising a predetermined number of unit substrates connected to each other.

At this time, each of the CB slits 49 may be so formed as to have a relatively large depth, which may be about one half of the thickness of the intermediate product 22A for example. In the state of the intermediate product 22A, baking has not been performed with respect to the substrate, the printed electrode paste and the printed resistor paste, so that the intermediate product has a suitable rigidity for allowing deformation. Therefore, it is possible to easily form the CB slits 49 with the cutter 48.

Moreover, in the prior art making method, the BB slits and the CB slits need be formed on the mother substrate with high accuracy in such a manner that the slits differ from each other in depths for example. In this embodiment, however, the formation of the CB slits 49 on the intermediate product 22 in the form of a narrow strip does not require highly accurate working for adjusting the depth of the slits. Therefore, it is possible to enhance the production efficiency.

It is to be noted that the width of the unit substrate 77 may be changed by changing the position at which the CB slit 49 is formed with the cutter 48.

Returning to FIG. 10, a transfer belt 51 and a baking furnace 52 are provided downstream from the transfer belt 46. The transfer belt 51 is in the form of a mesh and wound around a pair of rollers 53 which are rotatably arranged. The baking furnace 52 is provided for baking the substrate sub-strips 50, and the transfer belt 51 is so arranged as to pass through the baking furnace 52.

The substrate sub-strips 50, which are formed by dividing the intermediate product with the cutter 48, are disposed on the transfer belt 51 by the transfer belt 46 and then transferred downstream to be guided into the baking furnace 52. In the baking furnace 52, the substrate sub-strip 50 together with the electrode paste and the resistor paste deposited thereon are simultaneously baked. Generally, the baking temperature for the substrate differs from that for the paste. However, by making the substrate from glass ceramics containing alumina, the baking temperatures can be generally equalized to each other, so that it is possible to simultaneously bake the substrate sub-strip 50 and the paste.

The prior art making method includes a plurality of baking steps including the baking of the substrate in the making process and the baking of each kind of paste in the printing process. In this embodiment, however, it is possible to reduce the baking steps by simultaneously baking the substrate together with each kind of paste. Therefore, it is possible to reduce the baking equipment and shorten the time required for manufacturing.

In the above-described embodiment, baking was performed after the intermediate product is divided into the substrate sub-strips 50. Alternatively, however, baking may be performed in the state of the intermediate product 22A.

Figure 11:
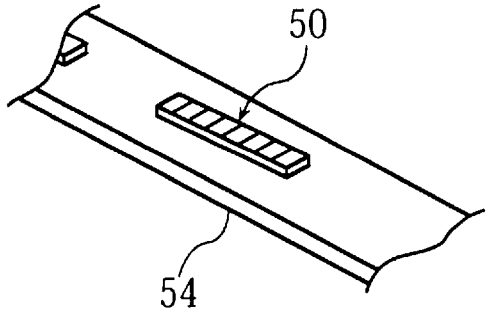
FIG. 11 is a perspective view showing a baked substrate sub-strip being transferred as attached onto a tape.
Figure 12A:
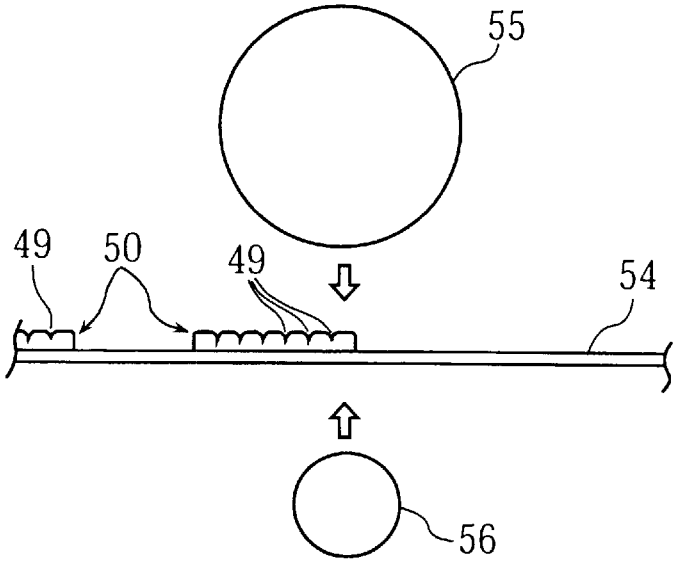
FIGS. 12A and 12B illustrate a step of dividing a substrate sub-strip after baking into unit substrates.
Figure 12B:
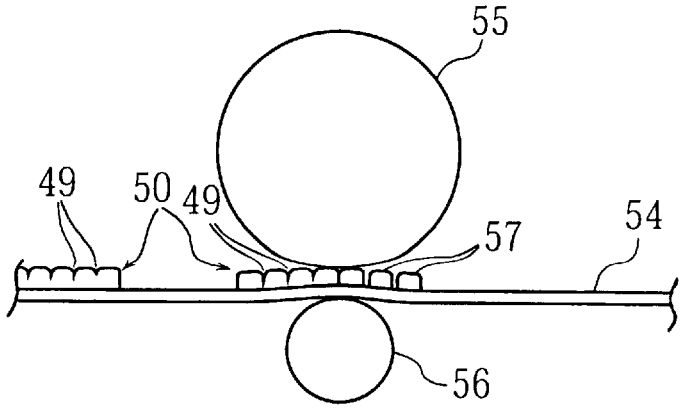

Subsequently, the method proceeds to a step of dividing each of the substrate sub-strips 50 into the unit substrates. Specifically, as shown in FIG. 11, the substrate sub-strip 50 baked in the baking furnace 52 is provisionally attached onto a tacky stretchable tape 54 having a tacky obverse surface. Then, as shown in FIGS. 12A and 12B, the substrate sub-strip 50 is transferred as closely sandwiched between dividing rollers 55, 56 which differ from each other in diameter and are disposed above and below. As a result, the substrate sub-strip 50 is divided into unit substrates 57 each having a configuration corresponding to that of a finally obtained chip resistor.

Specifically, the substrate sub-strip 50 is closely sandwiched between the dividing rollers 55, 56 arranged above and below. At this time, since the lower dividing roller 56 is smaller in diameter than the upper dividing roller 55, the substrate sub-strip 50 so warps as to bend downwardly and is divided along the CB slits 49 into the unit substrates by the rotation of the rollers 55, 56 (See FIG. 12B).

Since the substrate sub-strip 50 is divided along the CB slits 49 formed on the surface thereof, the division can be performed smoothly. Moreover, since the CB slits 49 are relatively deep, the division is performed without causing undesirable tearing or cracking so that generation of defective products can be prevented.

Figure 13:
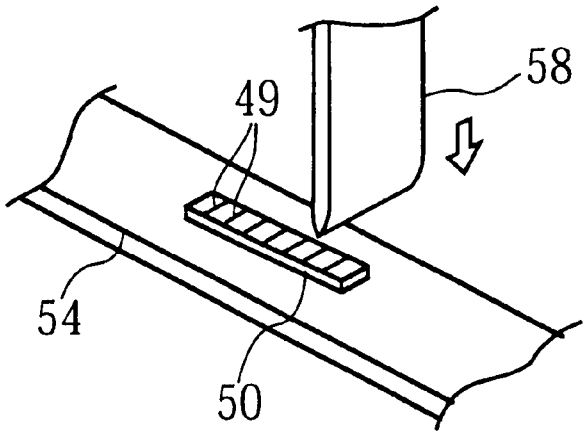
FIG. 13 illustrates another way of dividing a substrate sub-strip into unit substrates.

As shown in FIG. 13, the substrate sub-strip 50 may be divided into the unit substrates 57 by the use of a cutter 58. Specifically, the substrate sub-strip 50 and the double-sided tape may be cut widthwise into the unit substrates 57 by the cutter 58 which is movable upward and downward.

As described before, according to the above-described method, the thickness of the green sheet 18 can be changed by changing the position of the doctor blade 13. Further, the width of the intermediate product 22A can be changed by changing the positions of the plurality of rotating slitters 21. Furthermore, the width of the unit substrate 57 can be changed by changing the positions of the CB slits 49 formed by the cutter 48. Therefore, the thickness, the width and the length of the unit substrate 57 maybe adjusted as desired. Thus, it is possible to change the size of the unit substrate 57 more easily and quickly than in the case where the unit substrate 57 is formed by molding for example.

Figure 14:
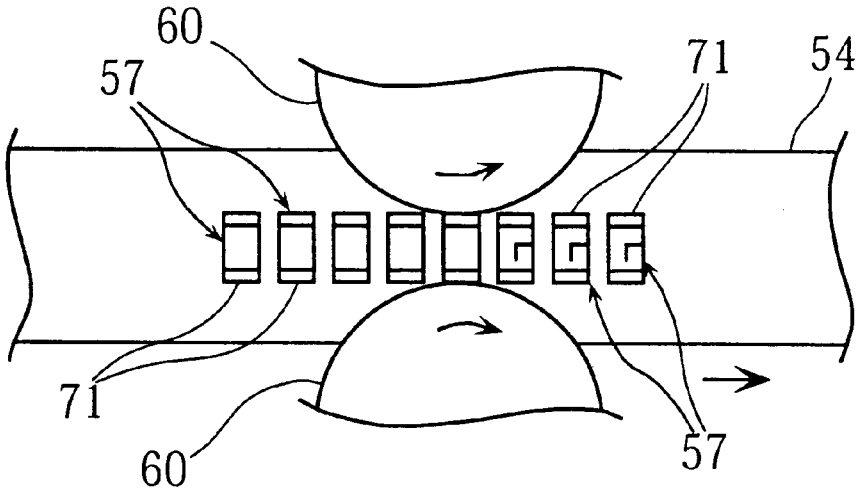
FIG. 14 illustrates the manner of adjusting resistance for each of unit substrates on a tape.

In this embodiment, the resistance of each of the resistor elements is adjusted after the division into the unit substrates 57. Specifically, subsequent to the process of dividing each of the substrate sub-strips 50 into the unit substrates 57, the tape 54 is stretched and held appropriately tensioned as shown in FIG. 14 so that the unit substrates 57 attached onto the tape 54 are spaced from each other by a predetermined distance. In this state, a pair of electrode rollers 60 are brought into contact with the film electrodes 71 formed on the side surfaces of each of the unit substrates 57. While measuring the resistance of the unit substrate 57 with the electrode rollers 60, trimming by laser beam application is performed for example to appropriately adjust the resistance.

In this way, by disposing the unit substrates 57 on the tape 54 in advance, it is possible to make the unit substrates 57 spaced from each other by stretching the tape 54. Therefore, it is possible to perform trimming properly while preventing the adjacent unit substrates 57 from contacting each other. It is to be noted that trimming may be performed while measuring the resistance of each individual electrode 57 with a probe instead of using the electrode rollers 60.

Figure 26:
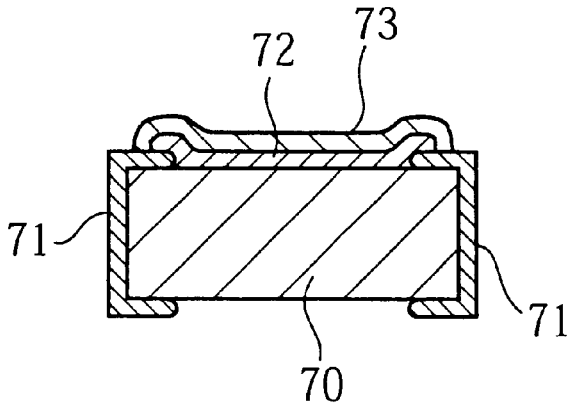
PRIOR ART FIG.26
FIG. 26 is a sectional view showing an example of chip resistor made by the method of the present invention.
Figure 27:
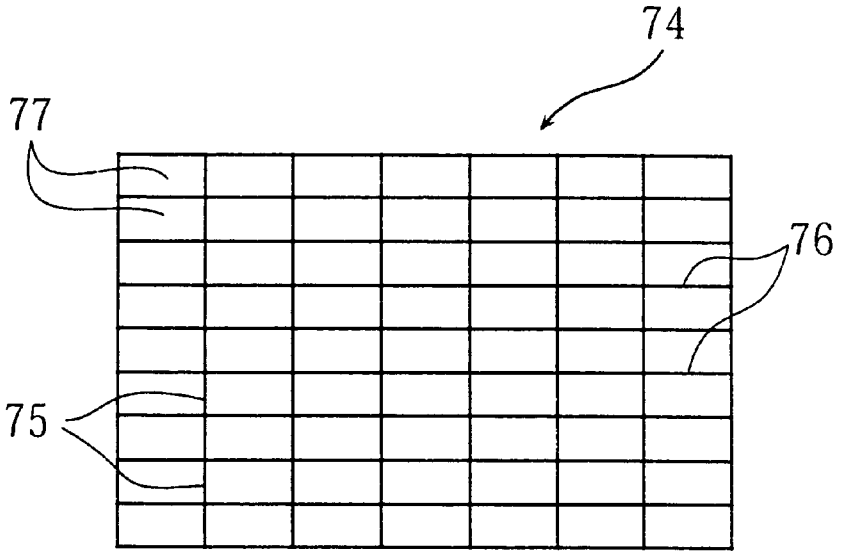
FIG.27 PRIOR ART
FIG. 27 depicts a prior art making method and shows a mother substrate before printing.
Figure 28:
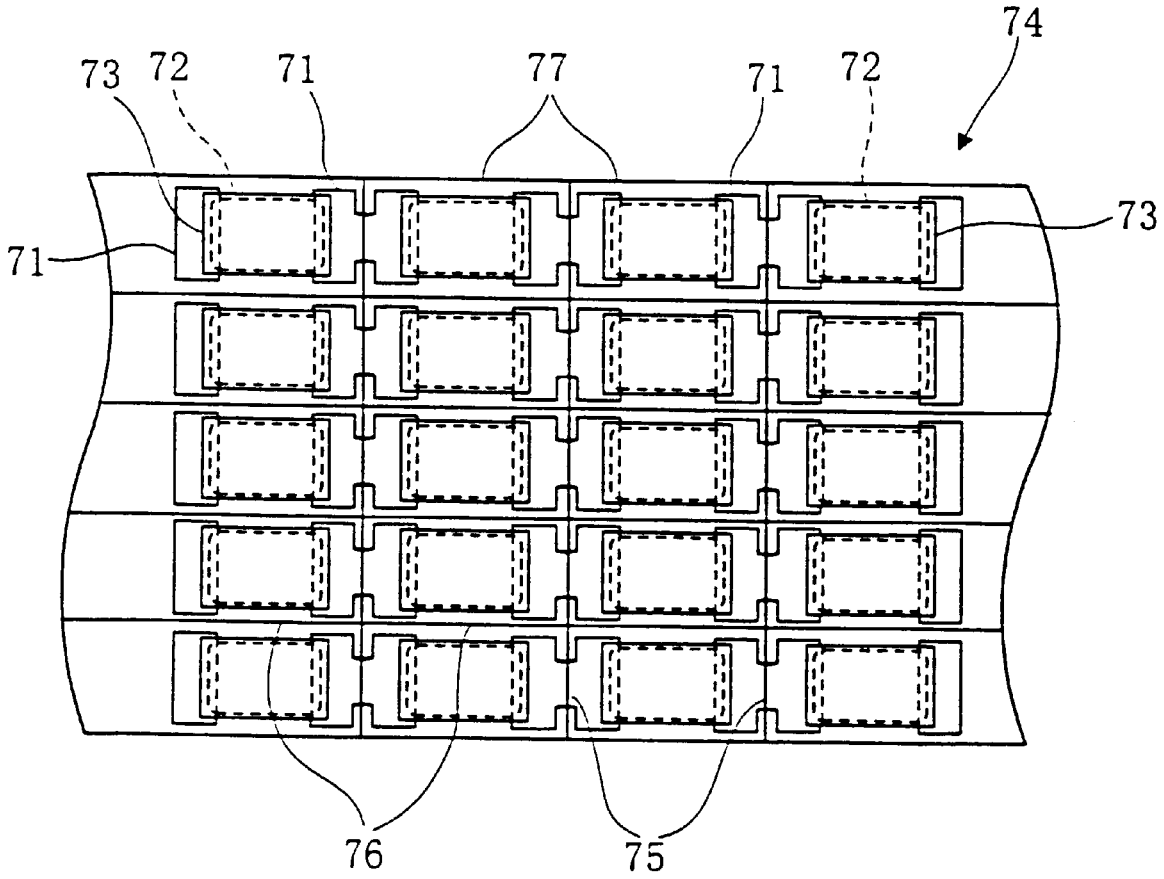
FIG.28 PRIOR ART
FIG. 28 is a plan view showing a part of the mother substrate of FIG. 27 on which electrodes and resistor elements are printed.
Figure 29:
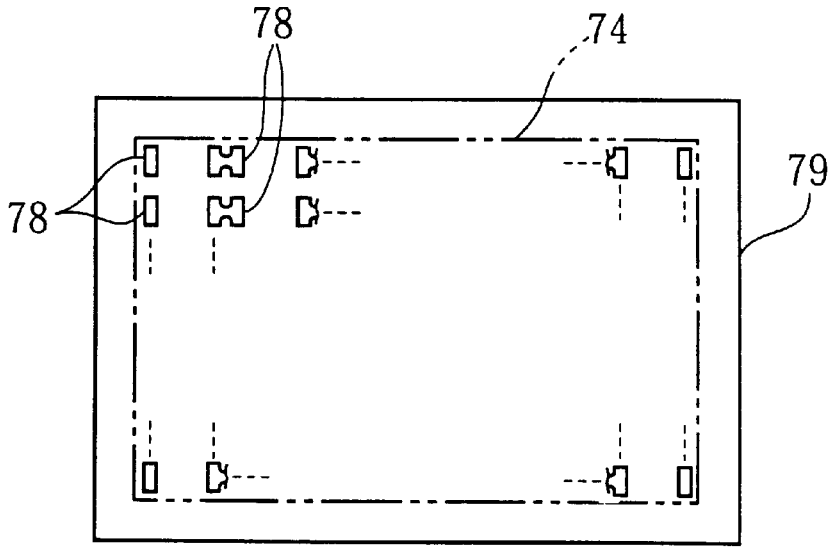
FIG.29 PRIOR ART
FIG. 29 illustrates a print mask used in performing printing as shown in FIG. 28.
Figure 30:
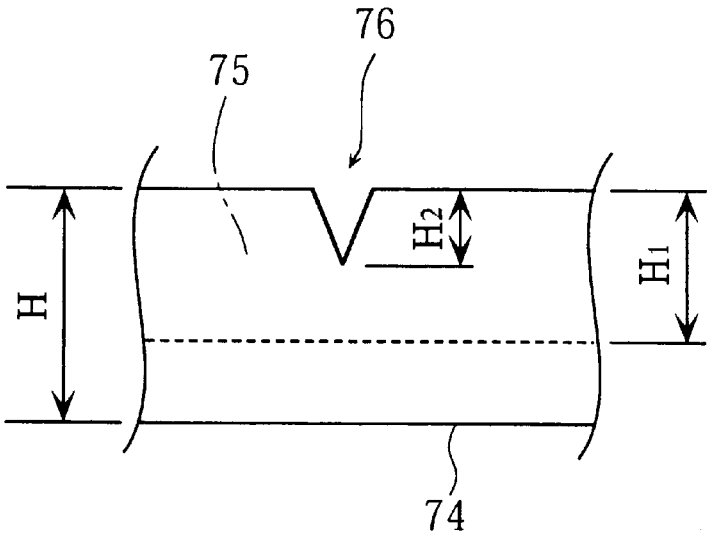
FIG.30 PRIOR ART
FIG. 30 is an enlarged sectional view showing a dividing slit to be formed on a mother substrate.

After resistance adjustment for each unit substrate 57 is completed, a protective coating 73 for covering the upper surface of the film resistor 72 for protection is formed (See FIG. 26). For forming the protective coating 73 on the unit substrate 57 as carried by the tape 54, the protective coating 73 may suitably be formed of ultraviolet-setting resin for example. Thereafter, the unit substrate 57 is peeled off the tape 54. Then, after plating and cleaning of the unit substrate 57 followed by marking on the surface thereof and taping or the like, the unit substrate is packaged as a product.

Figure 15:
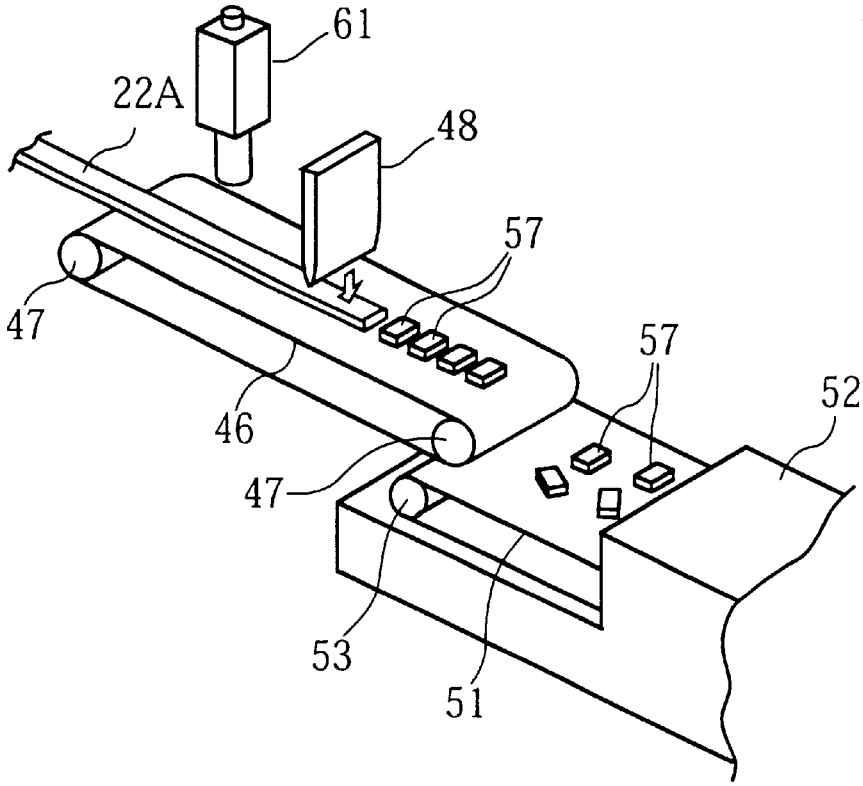
FIG. 15 illustrates a state in which an arrow substrate strip after printing is divided into unit substrates and baked.

In the above-described embodiment, baking is performed in the state of the substrate sub-strip 50. However, as shown in FIG. 15 for example, the intermediate product 22A on the transfer belt 46 may be cut, before baking, into unit substrates 57 by the cutter 48, and baking in the baking furnace 52 is then performed with respect to the unit substrates 57. Specifically, the unit substrates 57 divided on the transfer belt 46 are dropped from the transfer belt 46 to the transfer belt 51 and guided into the baking furnace 52. It is to be noted that indicated by reference sign 61 in FIG. 15 is a monitoring camera comprising e.g. a CCD camera for monitoring whether printing of paste by the printing rollers 41–45 (See FIG. 8) is properly performed.

Figure 16:
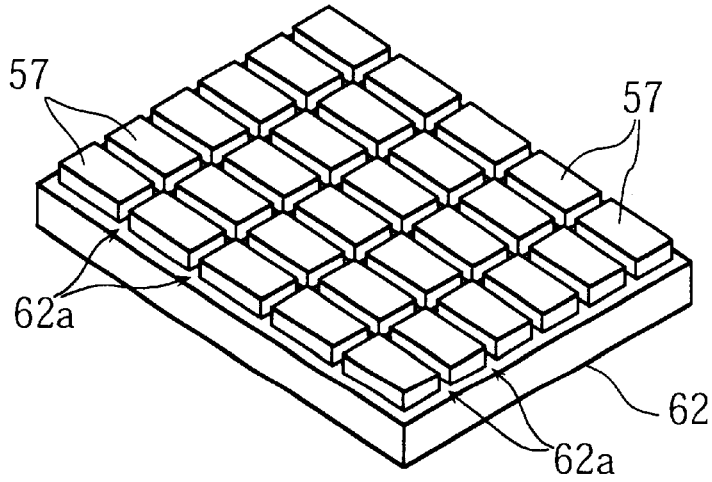
FIG. 16 illustrates baked unit substrates aligned in a tray.

The unit substrates 57 divided and baked in this way are transferred into a tray 62 having partition walls 62*a* provided in the form of a lattice, as shown in FIG. 16. The unit substrates 57 are aligned in the areas defined by the partition walls 62*a* and the resistance adjustment is performed with respect to each of the unit substrates 57. In the case where baking is performed in the state of unit substrates 57 as described above, the unit substrates 57 need be aligned one by one in the tray 62 after the baking for performing trimming, which may be troublesome. However, when the intermediate product 22 is divided into unit substrates 50 before baking and further divided on the tape 54 by the dividing rollers 55, 56 (FIGS. 12A and 12B), it is possible to subsequently perform trimming in that state. Therefore, it is possible to facilitate the operation of trimming and shorten the operation time.

In the above-described arrangement, the printing of electrodes and resistor elements on the narrow substrate strip 22 is performed by transfer printing using printing rollers 41, 42, 43, 44, 45 (FIG. 8). However, the method for printing is not limited to the transfer printing, and inkjet printing may be utilized for example.

Figure 17:
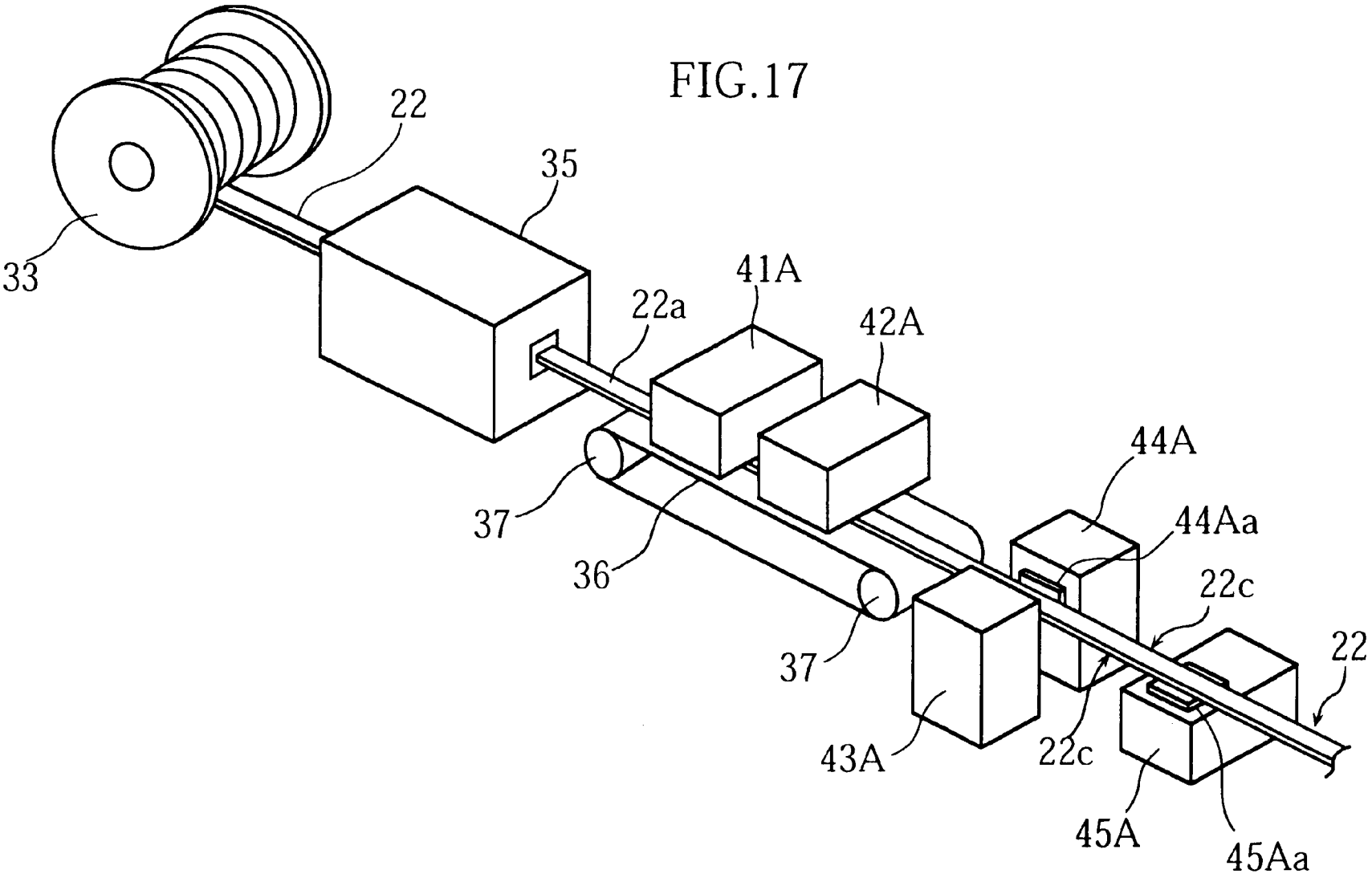
FIG. 17 is a schematic perspective view showing another example of printing apparatus for printing electrodes and resistor elements on a narrow substrate strip.

FIG. 17 illustrates an arrangement for performing inkjet printing.

For printing electrodes and resistor elements, a first printing apparatus 41A and a second printing apparatus 42A are provided above the transfer belt 36 for printing ink on the upper surface 22*a* of the narrow substrate strip 22. The first printing apparatus 41A is arranged upstream from the second printing apparatus 42A. Each of the printing apparatuses 41A, 42A includes a non-illustrated inkjet printhead facing the upper surface 22A of the narrow substrate strip 22. The inkjet printhead is formed with a nozzle having a plurality of minute holes.

For the first and the second printing apparatuses 41A, 42A for performing inkjet printing, use may be made of a so-called piezoelectric inkjet printhead which performs printing by pressurizing the ink with a piezoelectric element and ejecting the ink through the nozzles. ejecting the ink through the nozzles.

The ink here contains an electrode material or a resistor material mixed with a solvent to have a predetermined viscosity. Specifically, the electrode forming ink contains a conductive material such as silver as a main component. The resistor forming ink contains a metal or a metal oxide having predetermined electrical resistance properties.

Each of the first and the second printing apparatuses 41A, 42A is connected to and controlled by a non-illustrated controller. Specifically, each of the first and the second printing apparatuses 41A, 42A processes the print data transmitted from the controller to provide a printing pattern and makes the minutely bored nozzle eject the ink in accordance with the printing pattern. As a result, print dots are printed collectively at predetermined portions on a printing medium, i.e. the narrow substrate strip 22 to provide a predetermined printing pattern.

In this way, when the inkjet printing is utilized for conducting printing by the printing apparatuses 41A, 42A, every minute printing pattern can be easily formed in accordance with the print data transmitted from the controller. Therefore, it is possible to easily print electrodes and resistor elements on the narrow substrate strip 22 at a predetermined pitch so as to correspond to the unit substrates each of which has a configuration corresponding to a finally obtained chip resistor. Moreover, since each of the printing apparatuses 41A, 42A forms a printing pattern in accordance with the print data transmitted from the controller, just changing the print data allows formation of various electrode or resistor elements patterns as desired for application to various sizes of chip resistors.

Returning to FIG. 17, a third printing apparatus 43A and a fourth printing apparatus 44A for printing electrodes on the side surfaces 22*c* of the narrow substrate strip 22 are provided downstream from the transfer belt 36. Similarly to the first and the second printing apparatuses 41A, 42A, each of the printing apparatuses 43A, 44A utilizes ink jet printing and is connected to a non-illustrated controller for supplying print data. An inkjet printhead (not shown) of the third printing apparatus 43A and an inkjet printhead 44A*a* of the fourth printing apparatus 44A are so arranged as to face the side surfaces 22*c* of the narrow substrate strip 22.

Furthermore, a fifth printing apparatus 45A for printing electrodes on the lower surface 22*b* of the narrow substrate strip 22 is provided downstream from the third and the fourth printing apparatuses 43A, 44A. Similarly to the first through fourth printing apparatuses 41A–44A, the fifth printing apparatus 45A utilizes inkjet printing and is connected to the non-illustrated controller for supplying print data. The fifth printing apparatus 45A has an inkjet printhead 45A*a* arranged so as to face the lower surface 22*b* of the narrow substrate strip 22.

With the above-described structure, the narrow substrate strip 22 is transferred as disposed on the transfer belt 36 so that the upper surface 22*a* thereof faces the respective inkjet printheads of the printing apparatuses 41, 42. Then, in accordance with the print data transmitted from the controller, the electrode forming ink and the resistor forming ink are intermittently ejected from the respective printing apparatuses 41A, 42A through the nozzles provided in the printheads.

Figure 18:
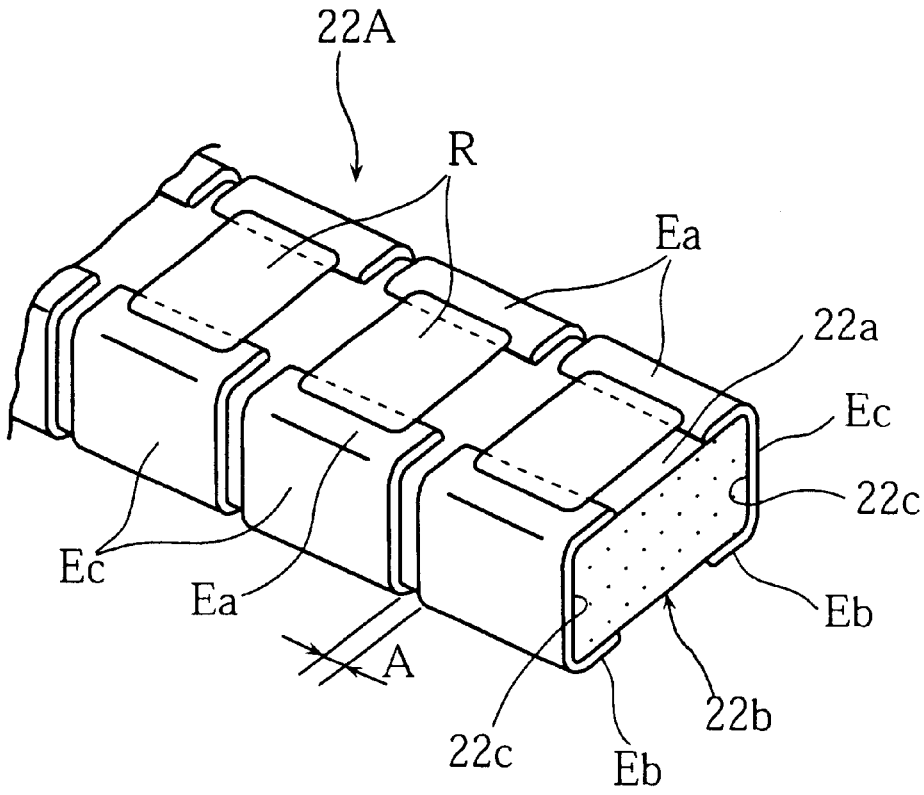
FIG. 18 is a perspective view showing a narrow substrate strip after electrodes and resistor elements are printed thereon by the printing apparatus shown in FIG. 17.

Thus, by the first printing apparatus 41A, electrodes Ea are printed at a predetermined pitch A at opposite edges on the upper surface 22*a* of the narrow substrate strip 22, as shown in FIG. 18. At this time, transferring by the transfer belt 36 may be once stopped and the printing apparatuses 41A, 42A may be translated relative to the narrow substrate strip 22 for performing the printing.

Thereafter, by the second printing apparatus 42A, resistor elements R are printed at predetermined portions of the narrow substrate strip 22 so as to extend widthwise of the substrate strip. At this time, the resistor elements R are so printed as to correspond to the electrodes Ea printed at the pitch A by the first printing apparatus 41A and so as to partially overlap the electrodes Ea at opposite edges on the upper surface 22*a* of the narrow substrate strip 22.

Preferably, non-illustrated blowers are provided between the first printing apparatus 41A and the second printing apparatus 42A as well as downstream from the second printing apparatus 42A. Thus, the narrow substrate strip 22 on which the electrodes and the resistor elements are printed by the printing apparatuses 41A, 42A is dried with air from the blowers.

Subsequently, the narrow substrate strip 22 on the upper surface 22*a* of which electrodes and resistor elements are printed is further transferred by the transfer belt 36 so that the side surfaces 22*c* thereof face the respective printheads of the third and the fourth printing apparatuses 43A, 44A. Thus, as shown in FIG. 18, electrodes Ec are printed by the third and the fourth printing apparatuses 43A, 44A. At this time, the electrodes Ec are so printed as to be electrically connected to and correspond in length to the electrodes Ea printed on the upper surface 22*a* of the narrow substrate strip 22, while keeping a predetermined spacing from the electrode of each adjacent unit substrate.

Preferably, a non-illustrated blower is provided downstream from the third and the fourth printing apparatuses 43A, 44A. Thus, the narrow substrate strip 22 on which electrodes are printed by the print apparatus 43A, 44A is dried with air from the blower.

The narrow substrate strip 22 on the side surfaces 22*c* of which the electrodes Ec are printed is further transferred by the transfer belt 36 so that the lower surface 22*b* thereof faces the printhead 45A*a* of the fifth printing apparatus 45A. Thus, electrodes Eb are printed at longitudinally opposite edges on the lower surface 22*b*. At this time, the electrodes Eb are so printed as to be electrically connected to and correspond in length to the electrodes Ec printed on the side surfaces 22*c* of the narrow substrate strip 22, while keeping a predetermined spacing from the electrode of each adjacent unit substrate.

Preferably, a non-illustrated blower is provided downstream from the fifth printing apparatus 45A. Thus, the narrow substrate strip 22 on which the electrodes Eb are printed by the fifth printing apparatus 45A is dried with air from the blower.

Wih respect to the intermediate product 22A thus obtained by printing electrodes and resistor elements on the narrow substrate strip 22, a slit forming step, a baking step, and a resistance adjustment step are performed. These steps may be performed in the same way as described with reference to FIGS. 10–14, but are not limited thereto.

As described above, in the case where the inkjet printing is utilized as described above, printing of the electrodes and resistor elements can be easily performed at a predetermined pitch corresponding to the dimension of the unit substrate. Therefore, it is possible to perform the resistance adjustment in the state of the baked intermediate product 22A or the substrate sub-strip 50 obtained by dividing the intermediate product into a predetermined length, instead of performing after the division into unit substrates.

Figure 19:
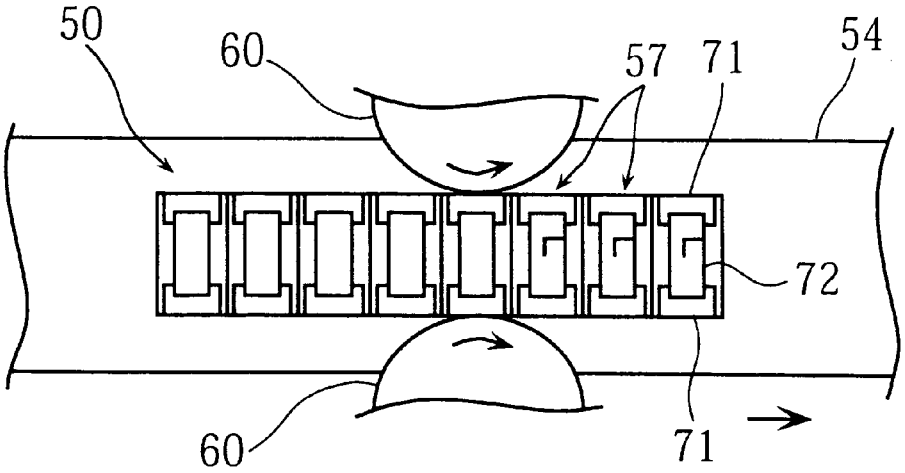
FIG. 19 illustrates the manner of adjusting resistance for each of unit substrates on a tape.

Specifically, as shown in FIG. 19, the baked substrate sub-strip 50 is disposed on the stretchable tape 54. In this state, electrode rollers 60 are brought into contact with the film electrodes 71 formed on the side surfaces of the substrate sub-strip 50 for measuring the resistance of the film resistor 72 of each of the unit substrates 57. In this state, trimming by laser beam application for example is performed with respect to the film resistor 72 for appropriately adjusting the resistance. Since the adjacent film electrodes 71 are spaced from each other, it is possible to perform the resistance adjustment by laser trimming in the state of the substrate sub-strip 50 while performing resistance measurement individually with respect to each of the film resistors 72.

In this case, after the resistance adjustment is performed, the substrate sub-strip 50 is divided into unit substrates. Similarly to the case described with reference to FIGS. 12A and 12B, the division can be performed by attaching the substrate sub-strip 50 onto the tape 54, tightly sandwiching the substrate sub-strip from above and below between the dividing rollers 55, 56, and rotating the rollers.

Next, a second embodiment of a chip resistor making method according to the present invention will be described mainly with reference to FIGS. 20 and 21. In this embodiment, a green sheet 18 can be continuously formed in a way similar to that described with reference to FIG. 1 in the first embodiment.

From the green sheet 18, an intermediate product 22A is obtained, which is in the form of a narrow strip and is provided with electrodes and resistor elements printed thereon so that at least the resistor elements are arranged at a pitch corresponding to the unit substrates. Unlike the first embodiment, the intermediate product is obtained, in this embodiment, by printing and baking electrodes and resistor elements in a matrix arrangement on an upper surface of the green sheet, dividing the green sheet into narrow substrate strips, and forming electrodes on the side surfaces and the lower surface of each of the narrow substrate strip 22.

Detailed description will be given below.

Figure 20:
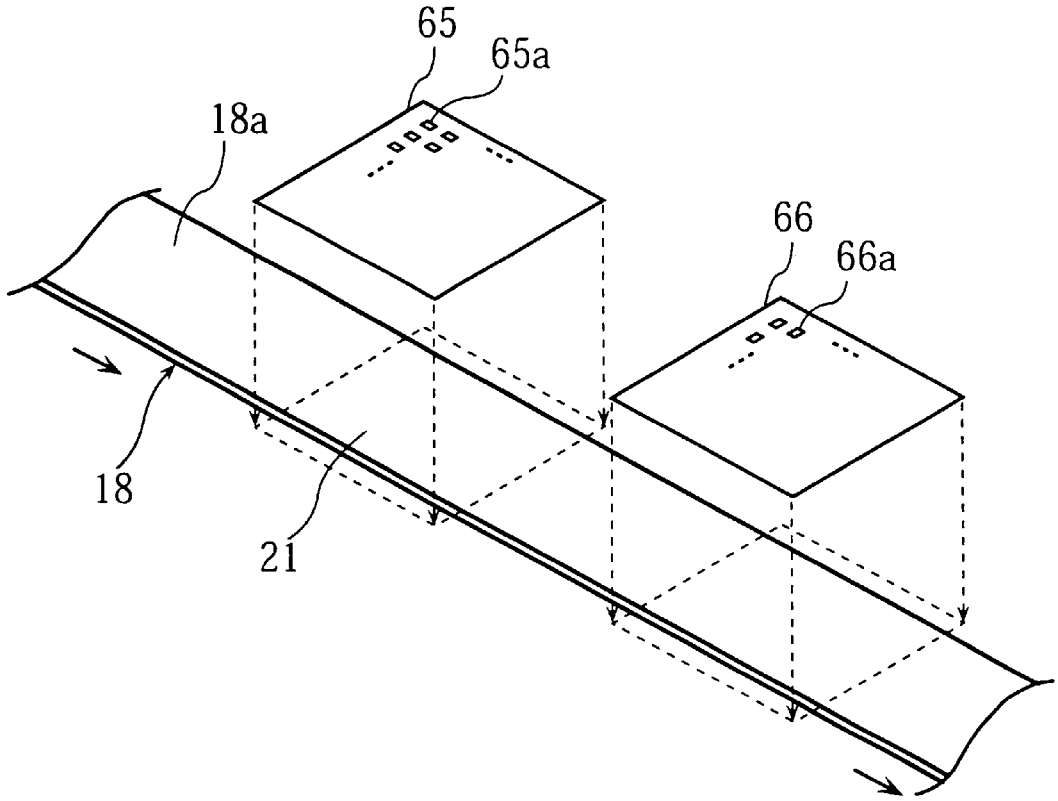
FIG. 20 illustrates the manner of printing electrodes and resistor elements in a matrix arrangement on a green sheet.

As shown in FIG. 20, an electrode print mask 65 having openings 65*a* formed in accordance with the printing pattern of film electrodes 71 is disposed at a predetermined portion 21 of an upper surface 18*a* of the green sheet 18 which has undergone the aging. Subsequently, electrode paste is applied on the electrode print mask 65. By subsequently moving a squeegee on the electrode print mask 65 for example, the electrode paste is applied through the openings 65*a* onto the green sheet 18.

Then, the green sheet 18 is transferred by a predetermined distance, and a resistor print mask 66 having openings 66*a* formed in accordance with the printing pattern of resistor elements is disposed on the green sheet 18 so as to coincide with the portion 21. Thus, similarly to the printing of the electrode paste, the resistor paste is applied through the openings 66*a* formed in the resistor print mask 66 onto the portion 21.

Figure 21:
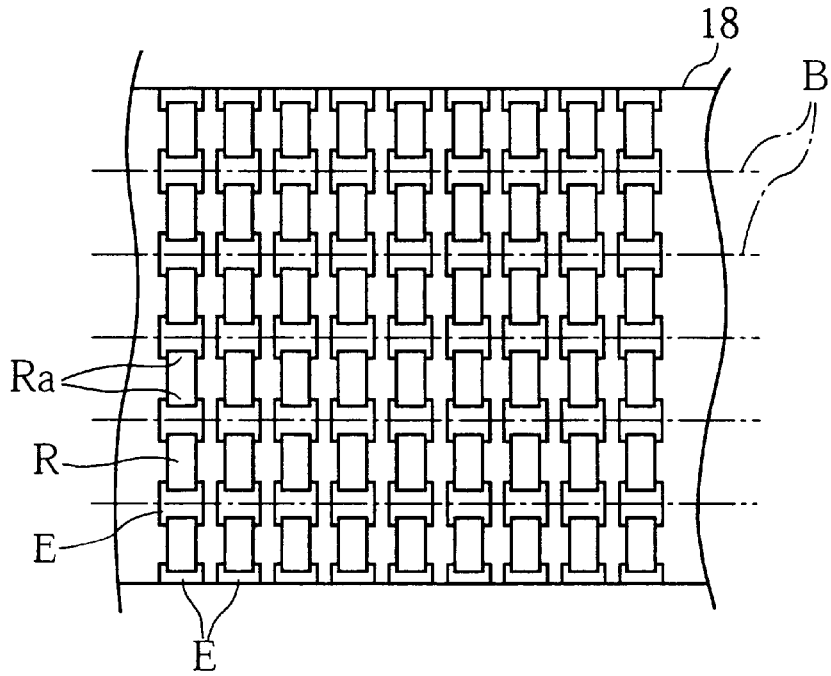
FIG. 21 is a plan view showing a part of a green sheet on which electrodes and resistor elements are printed in a matrix arrangement.

As a result, as shown in FIG. 21, electrodes E and resistor elements R are formed in a matrix arrangement on the green sheet 18. Each of the resistor elements R, which is generally rectangular, includes opposite ends Ra overlapping the corresponding electrodes E.

Figure 22:
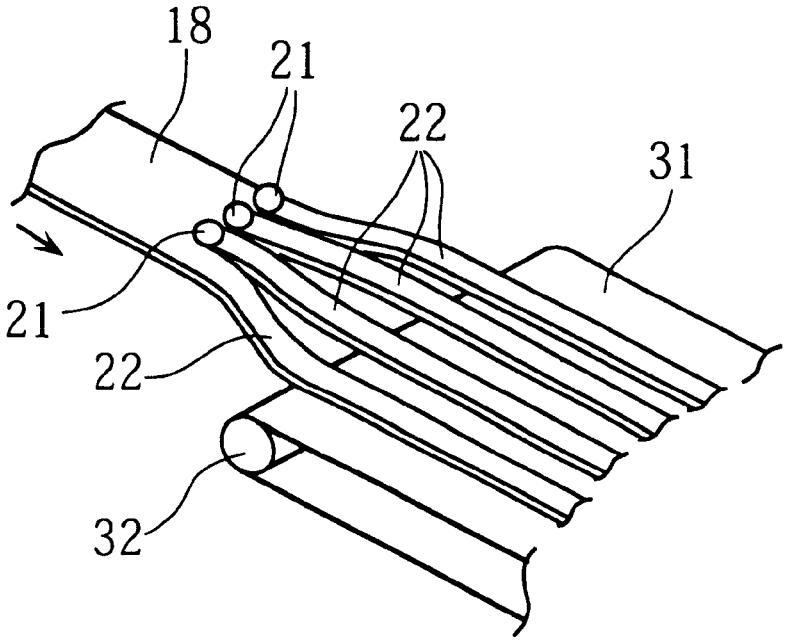
FIG. 22 illustrates the state in which a green sheet on which printing is performed as shown in FIG. 21 is being divided into narrow substrate strips.

Subsequently, as shown in FIG. 22, the green sheet 18 is cut by a plurality of rotating slitters 21 into a plurality of narrow substrate strips 22 extending longitudinally of the green sheet 18 and having a width corresponding to a unit substrate.

Figure 23:
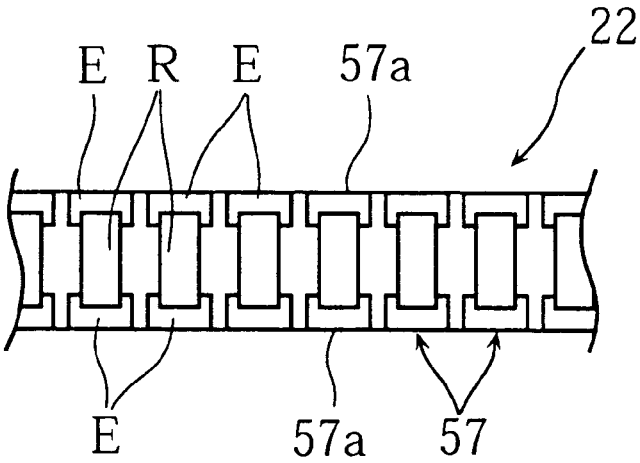
FIG. 23 is a plan view showing a narrow substrate strip divided as shown in FIG. 22.

At this time, the intermediate product 25 is cut along chain lines B depicted in FIG. 21 so that each of the electrodes E is halved longitudinally of the green sheet 18. Thus, the green sheet 18 is cut so that unit substrates 57, each of which is generally in the form of a rectangular parallelepiped, are widthwise aligned and that opposite edge surfaces of each unit substrate 57 are exposed, as shown in FIG. 23. In this way, by performing cutting so as to expose the opposite edge surfaces 57*a* of the unit substrate 57, it is possible, in the subsequent process steps, to easily form electrodes on the edge surfaces 57*a* of the individual unit substrate 57 and to reliably perform resistance adjustment.

Figure 24:
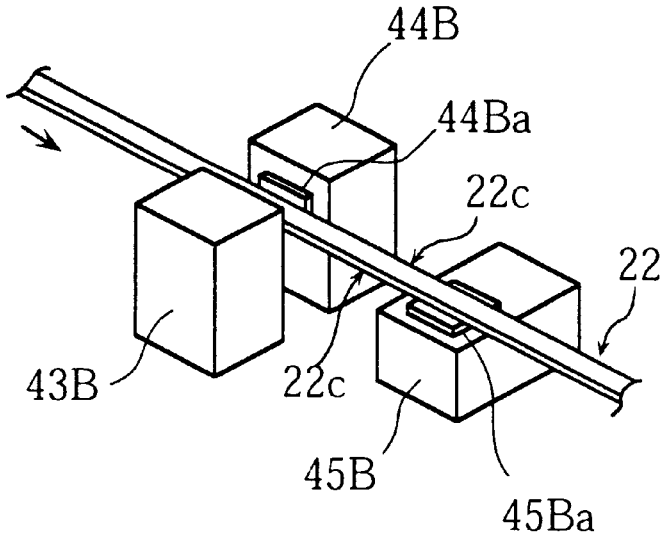
FIG. 24 is a schematic perspective view showing a printing apparatus for printing electrodes on the side surfaces and the lower surface of the narrow substrate strip shown in FIG. 23.

Subsequently, electrodes are printed on the side surfaces and the lower surface of the narrow substrate strip 22. This may be performed by inkjet printing. For this purpose, as shown in FIG. 24, there are provided a first printing apparatus 43B and a second printing apparatus 44B for ejecting ink to the side surfaces 22*c* of the narrow substrate strip 22. The printing apparatuses 43B, 44B include respective printheads arranged in facing relationship to the side surfaces 22*c* of the narrow substrate strip 22, respectively.

Further, a third printing apparatus 45B for printing electrodes on the lower surface 22*b* of the narrow substrate strip 22 is provided downstream from the first and the second printing apparatuses 43B, 44B. The third printing apparatus 45B has a printhead 45B*a* arranged so as to face the lower surface 22*b* of the narrow substrate strip 22.

Each of the first through the third printing apparatuses 43B–45B is connected to and controlled by a non-illustrated controller for supplying print data. Specifically, each of the first through the third printing apparatuses 43B–45B processes the print data transmitted from the controller to provide a printing pattern and makes the minutely bored nozzle eject the ink in accordance with the printing pattern.

With the above arrangement, the narrow substrate strip 22 is first dried with air from the non-illustrated blower while being transferred by a non-illustrated transfer belt. Then, the narrow substrate strip 22 is further transferred so that the side surfaces 22*c* thereof face the respective inkjet printheads of the printing apparatuses 43B, 44B. Thus, in accordance with the printing data transmitted from the controller, the electrode forming ink is intermittently ejected from the nozzles formed in the printheads of the printing apparatuses 43B, 44B.

Figure 25:
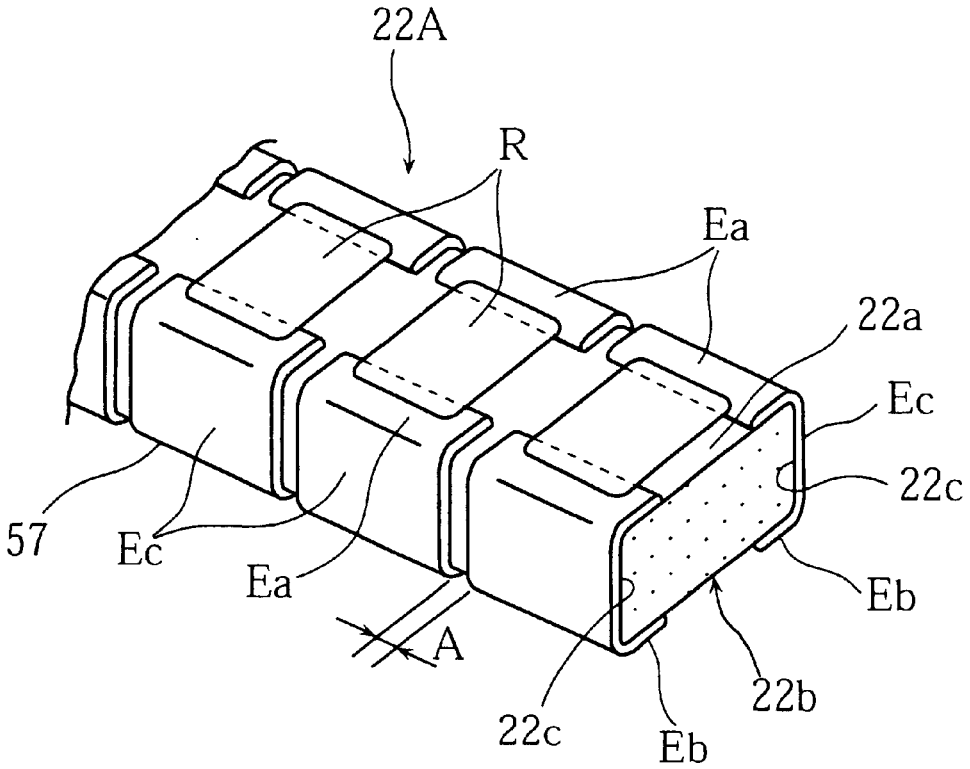
FIG. 25 is a perspective view showing a narrow substrate strip on which printing is performed by the printing apparatus shown in FIG. 23.

Thus, by the first and the second printing apparatuses 43B, 44B, electrodes Ec are printed on the respective side surfaces 22*c* of the narrow substrate strip 22 at a predetermined pitch A longitudinally of the narrow substrate strip 22, as shown in FIG. 25. At this time, the electrodes Ec are so printed as to be electrically connected to and correspond in length to electrodes Ea printed on the upper surface 22*a* of the narrow substrate strip 22, while keeping the predetermined spacing A from the electrode of each adjacent unit substrate 57.

The narrow substrate strip 22 on the side surfaces 22*c* of which the electrodes Ec are printed is further transferred so that the lower surface 22*b* faces the printhead 45B*a* of the third printing apparatus 45B. Thus, electrodes Eb are printed at longitudinally opposite edges of the lower surfaces 22*b*. At this time, the electrodes Eb are so printed as to be electrically connected to and correspond in length to the electrodes Ec printed on the side surfaces 22*c* of the narrow substrate strip 22, while keeping the predetermined spacing A from the electrode of each adjacent unit substrate 57.

Preferably, non-illustrated blowers are provided between the first or second printing apparatus 43B, 44B and the third printing apparatus 45B as well as downstream from the third printing apparatus 45B, respectively. Thus, the narrow substrate strip 22 on which the electrodes are printed by the printing apparatuses 43B–45B is dried with air from the blowers. The intermediate product 22A may be further formed with a coating called "G1" provided on the resistor paste.

In this way, by performing inkjet printing with the printing apparatuses 43B–45B, a relatively minute printing pattern can be easily formed. Thus, by the printing apparatuses 43B–45B, it is possible to easily print electrodes on the narrow substrate strip 22 at a predetermined pitch corresponding to the unit substrates. Since each of the printing apparatuses 43B–45B forms a printing pattern in accordance with the print data transmitted from the controller, just changing the print data enables formation of various electrode patterns as desired for application to various sizes of chip resistors.

Of course, instead of the inkjet printing, the printing of electrodes on the side and the lower surfaces of the narrow substrate strip 22 may be performed by the transfer printing using printing rollers, as described with reference to FIG. FIG. 8 with respect to the first embodiment.

Subsequently, the method proceeds to a step of forming, on the intermediate product 22A, slits for dividing the substrate into unit substrates and a step for forming the substrate sub-strips 50. These steps may be performed in a similar way to that described with reference to FIG. 10 with respect to the first embodiment.

Then, the method proceeds to a step of baking the substrate sub-strips 50. This step may also be performed similarly to the first embodiment as described with reference to FIG. 10.

Subsequently, resistance adjustment is performed with respect to each of the unit substrate. The resistance adjustment may be performed in the state of the substrate sub-strip 50 or after the substrate sub-strip 50 is divided along the CB slits into unit substrates. The resistance adjustment in the state of the substrate sub-strip 50 may be performed in the manner as described with reference to FIG. 19 with respect to the first embodiment. The resistance adjustment after the division into the unit substrates may be performed as described with reference to FIG. 4. Specifically, the tape used in dividing the substrate is stretched to separate the unit substrates from each other, and laser trimming is performed to provide predetermined resistance while measuring the resistance across opposite electrodes of each unit substrate by the use of electrodes rollers 60.

Further, similarly to the above, a protective coating 73 for covering the film resistor 72 is finally formed on of the unit substrates. The protective coating 73 may suitably formed of ultraviolet-curing resin. Thereafter, the unit substrate 57 is peeled off the tape 54. Then, after plating and cleaning of the unit substrate 57 followed by marking on the surface thereof and taping or the like are performed, the unit substrate is packaged as a product.

The present invention is not limited to the above-described embodiment, and all modifications as would be obvious to those skilled in the art are intended to be included within the scope of the following claims.

What is claimed is:

1. A method of making chip resistors each of which comprises a unit substrate which is rectangular as viewed in plan and has a predetermined thickness, a resistor element provided on an upper surface of the substrate, and electrodes provided at opposite ends of the unit substrate, the method comprising the steps of:

continuously forming a green sheet;

obtaining from the green sheet an intermediate product in the form of a narrow strip on which electrodes and resistor elements are printed, at least the resistor elements being printed at a pitch corresponding to the unit substrates;

forming slits on the intermediate product for dividing the intermediate product into the unit substrates, each of the slits extending perpendicularly to the longitudinal direction of the intermediate product;

simultaneously baking the intermediate product together with the printed electrodes and the printed resistor elements; and dividing the baked intermediate product along the slits into the unit substrates;

wherein the step of obtaining the intermediate product is performed by cutting the green sheet into a narrow substrate strip of a predetermined width extending longitudinally of the green sheet.

2. The chip resistor making method according to claim 1, wherein corners of the substrate strip are rounded in cutting the green sheet into the narrow substrate strip of the predetermined width.

3. The chip resistor making method according to claim 1, wherein an upper surface of the narrow substrate strip is formed, at widthwise opposite edges thereof, with longitudinally extending stepped portions of a predetermined width.

4. The chip resistor making method according to claim 1, wherein an upper surface of the narrow substrate strip is formed, at a widthwise central portion thereof, with a longitudinally extending recess having a predetermined width.

5. The chip resistor making method according to claim 1, wherein, in the step of obtaining the intermediate product, the electrodes and the resistor elements are printed by longitudinally transferring the narrow substrate strip and rotating printing rollers in contact with an upper surface, side surfaces and lower surface of the narrow substrate strip.

6. The chip resistor making method according to claim 1, wherein, in the step of obtaining the intermediate product, the narrow substrate strip is longitudinally transferred while the electrodes and the resistor elements are printed by performing inkjet printing with respect to an upper surface, side surfaces and lower surface of the narrow substrate strip.

7. The chip resistor making method according to claim 1, wherein, in the step of forming the slits on the intermediate product, each of the slits is formed to have a depth which is about one half of a thickness of the intermediate product.

8. The chip resistor making method according to claim 1, wherein the step of dividing the baked intermediate product along the slits into the unit substrates is performed by attaching the baked intermediate product onto a stretchable tape for transferring while tightly sandwiching the same between dividing rollers provided above and below.

9. The chip resistor making method according to claim 8, further including the step of performing resistance adjustment after the division into the unit substrates, the resistance adjustment being performed while conducting resistance measurement for each of the resistor elements by bringing electrode rollers into contact with corresponding electrodes of each unit substrate with the stretchable tape stretched.

10. The chip resistor making method according to claim 1, wherein each of the resistor elements is subjected to resistance adjustment with respect to the intermediate product after the baking.

11. The chip resistor making method according to claim 10, wherein the resistance adjustment for each of the resistor elements is performed while performing resistance measurement for the resistor element by bringing electrode rollers into contact with corresponding electrodes on the intermediate product.

12. The chip resistor making according to claim 1, wherein the step of obtaining the intermediate product is performed by cutting the green sheet into the substrate strip of a predetermined width after printing a plurality of electrodes and resistor elements on an upper surface of the green sheet in a matrix arrangement.

13. The chip resistor making method according to claim 12, wherein, in printing the plurality of electrodes and resistors on the upper surface of the green sheet in the matrix arrangement, a print mask is used which includes openings corresponding to an electrode pattern or a resistor element pattern.

* * * * *